US012727631B2

(12) United States Patent
Ylitalo et al.

(10) Patent No.: US 12,727,631 B2
(45) Date of Patent: Sep. 8, 2026

(54) SYSTEM AND METHOD FOR FORMING NOSE CLIP FOR IMPROVED FACE MASK FIT

(71) Applicant: 3M INNOVATIVE PROPERTIES COMPANY, St. Paul, MN (US)

(72) Inventors: Caroline M. Ylitalo, Stillwater, MN (US); Marie D. Manner, St. Paul, MN (US); Claire R. Donoghue, Reading (GB); Phillip A. Kennedy, Berkshire (GB)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 307 days.

(21) Appl. No.: 18/558,560

(22) PCT Filed: Apr. 25, 2022

(86) PCT No.: PCT/IB2022/053822

§ 371 (c)(1),
(2) Date: Nov. 2, 2023

(87) PCT Pub. No.: WO2022/234390

PCT Pub. Date: Nov. 10, 2022

(65) Prior Publication Data

US 2024/0215663 A1 Jul. 4, 2024

Related U.S. Application Data

(60) Provisional application No. 63/201,603, filed on May 6, 2021.

(51) Int. Cl.
*A41D 13/11* (2006.01)

(52) U.S. Cl.
CPC ..... *A41D 13/1161* (2013.01)

(58) Field of Classification Search
CPC ..... A41D 13/11–1192
See application file for complete search history.

(56) References Cited

U.S. PATENT DOCUMENTS 4,231,360 A 11/1980 Zloczysti et al.
2014/0278319 A1 9/2014 Thiruvengada et al.
(Continued)

FOREIGN PATENT DOCUMENTS

CN 103568305 B 9/2016
CN 111248532 A 6/2020
WO 2007024865 A1 3/2007

OTHER PUBLICATIONS

International Search Report for PCT International Application No. PCT/IB2022/053822, mailed on Jul. 19, 2022, 3 pages.
(Continued)

*Primary Examiner* — Elliot S Ruddie
(74) *Attorney, Agent, or Firm* — Katherine M. Scholz

(57) ABSTRACT

A custom nose portion former for a respiratory protection device is presented. The former comprises a first portion comprising a nose contour. The nose contour matches a facial skin surface topography of a user of the respiratory protection device. The former comprises a second portion. When the first portion and the second portion, when engaged around a deformable nose portion within the respiratory protection device, form it to match first nose contour such that the face mask is custom fit to the user.

11 Claims, 19 Drawing Sheets

(56) References Cited

U.S. PATENT DOCUMENTS

| | | | |
|---|---|---|---|
| 2015/0352382 | A1 | 12/2015 | Jayaraman et al. |
| 2018/0264294 | A1 | 9/2018 | Hancock et al. |

OTHER PUBLICATIONS

Nose Clip-Printable 3D Models, Yeggi, [retrieved from the internet on Jan. 2, 2024], URL <https://www.yeggi.com/q/nose+clip/>, 5 pages.

Yan, "How to build a Nose-clip to improve your mask and better protect yourself", Apr. 2020, [retrieved from the internet on Jan. 2, 2024], URL <https://www.youtube.com/watch?v=HxYj6oGGABE>, 3 pages.

SYSTEM AND METHOD FOR FORMING NOSE CLIP FOR IMPROVED FACE MASK FIT

CROSS REFERENCE TO RELATED APPLICATIONS

This application is a national stage filing under 35 U.S.C. 371 of PCT/IB2022/053822, filed Apr. 25, 2022, which claims the benefit of U.S. Provisional Application No. 63/201,603, filed May 6, 2021, the disclosure of which is incorporated by reference in its entirety herein.

BACKGROUND

As a commonly used protective article, a respiratory protection device is often used to protect against dust, mist, bacteria, etc., and is widely used in specific working environments and daily life. Respiratory protection devices are designed to provide a barrier to particulates and airborne or droplet-borne diseases, both by keeping exhalations from a sick individual contained and by providing a barrier from the coughs or exhalations of others.

SUMMARY

An objective of the present invention is to provide an improved seal between a face mask and the face of the user, so as to improve the wearing comfort as well as the sealing between the mask and the face of a wearer. Another objective of the present invention is to provide a method for manufacturing a tool that provides the improved seal quickly, and with a custom design for the individual user.

A custom nose portion former for a respiratory protection device is presented. The former comprises a first portion comprising a nose contour. The nose contour matches a facial skin surface topography of a user of the respiratory protection device. The former comprises a second portion. When the first portion and the second portion, when engaged around a deformable nose portion within the respiratory protection device, form it to match first nose contour such that the face mask is custom fit to the user.

BRIEF DESCRIPTION OF THE DRAWINGS

The embodiments of the present invention are described below merely as examples with reference to the accompanying drawings. In the accompanying drawings, the same features or components are represented by the same reference numerals, and the accompanying drawings are not necessarily drawn to scale. Further, in the accompanying drawings.

DETAILED DESCRIPTION

Figure 1:
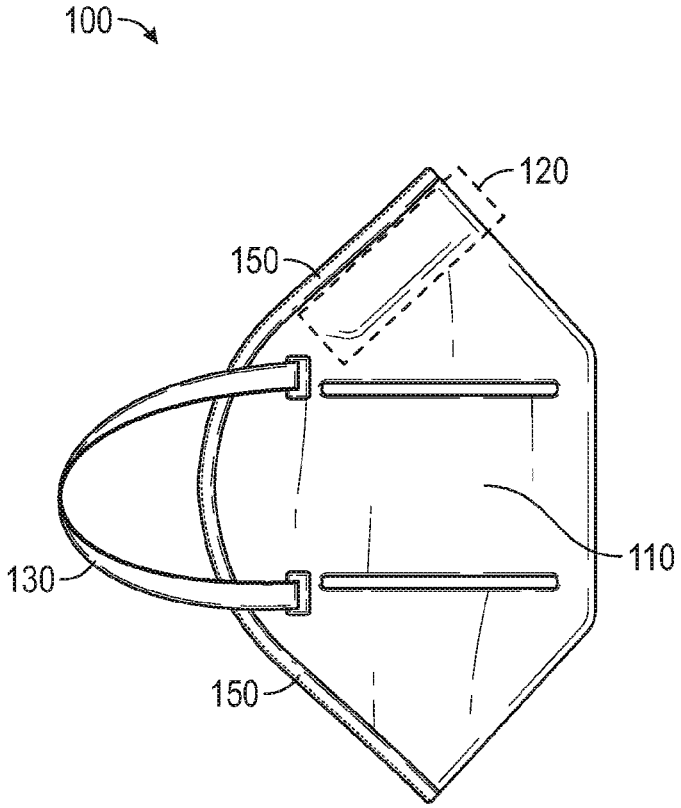
FIG. 1 is a view of a respirator.

The following descriptions are substantially merely exemplary, and are not intended to limit the present invention, the application, and the use. It should be understood that in all of the accompanying drawings, similar reference numerals represent the same or similar parts and features. The accompanying drawings illustratively show the idea and principles of the embodiments of the present invention, but do not necessarily show specific size of each embodiment of the present invention and the scale thereof. In some parts of specific accompanying drawings, related details or structures of the embodiments of the present invention may be illustrated in an exaggerated manner.

In the description of the embodiments of the present invention, related directional terms such as "upper," "lower," "left," and "right" are used for description in upper, lower, left, and right positions in the views shown in the accompanying drawings. In practical applications, the positional relationships of "upper," "lower," "left," and "right" used herein may be defined according to actual situations, and these relationships can be reversed.

The use of personal protective equipment (PPE) has become an important part of the strategy to limit the spread of respiratory infections. Respiratory protection devices have become increasingly important globally as COVID-19 has spread. Two types of respiratory protection devices are in increasingly common use: filtering facepiece respirators (FFRs) and face masks (commonly called masks, often made of cloth). As used herein the term "respiratory protection devices" may refer to respirators, face masks, or other facial coverings.

The term "face mask" generally refers to a face covering that inhibits droplets from the wearer from spreading, e.g. from a couch or a sneeze. However, face masks often provide little or no protection against droplets from another individual. FFRs, in contrast, are designed to seal to a user's face, such that inhaled air is forced through one or more filter layers, such that most droplets, microbes, and particulates are removed from inhaled air before it reaches a wearer. Additionally, some FFRs include charged fibers that attract microbes or particulates, providing increased protection. While respirators and facemasks are very different in intended use, fit against the face, and regulatory approvals, both may benefit from systems and methods used herein.

Filtering facepiece respirators (FFRs) are sometimes referred to as disposable respirators (DRs). When worn properly; FFRs are designed to protect the wearer by removing harmful particles from inhaled air. FFRs are regulated by the National Institute for Occupational Safety and Health (NIOSH). To provide the required level of protection, an FFR must seal to the wearer's face, preventing gaps between the respirator and the wearer's skin since such gaps can allow contaminated air to leak into the breathing zone of the wearer. Therefore, tight fit of the FFR to the face of the wearer is essential.

Respiratory protection devices are mass produced with the goal of fitting many different facial structures, including male and female, high or low cheekbones, different racial background, prominent jaws, etc. Additionally, respiratory protection devices are often worn during activity, such that the wearer may have different facial expressions during use, may walk or run, may sweat or laugh. Additionally, different types and different models of respiratory protection devices may be worn at different facial positions for the same user, depending on usage or activity.

Ideally, when worn, a respiratory protection device should fit the contour of the face of a wearer to form good sealing between the respiratory protection device and the face of the wearer. However, the contour of the face of the wearer is not the same between individuals, and wearers have large individual differences. The skin surface topography of the nose is complex and fluctuates: it is often difficult to form a good seal with the respirator, and a gap is often present between the respiratory protection device and the nose area of the wearer, resulting in a poor sealing effect. As a result, dust, mist or bacteria in an environment where the wearer is located will be in contact with the wearer through the gap and is inhaled by the wearer, thus affecting the protective effect of the respirator. Additionally, the exhaled breath of the wearer will also be discharged upwards through this gap. For the case where the wearer wears glasses, if the temperature in the respirator is higher than the ambient temperature, the exhaled breath will cause fogging and affect the wearing experience of the wearer.

Therefore, in order to improve the protective effect of the respiratory protection device and improve the wearing experience, it is expected that the respirator can fit the skin surface topography of the face of the wearer and achieve good sealing between the respirator and the face of the wearer. In some existing respirators, a metal or plastic nose strip with a memory effect is used. When this type of respirator is worn, by applying a pressure to this part of the respirator, the nose strip of the respirator is deformed to fit the skin surface topography of the nose of the wearer, so that the respirator is pressed against and fits the face of the wearer, thus improving the sealing between the respirator and the nose of the wearer. However, the pressure applied to the nose of the wearer by the nose strip of such a respirator is prone to cause discomfort to the wearer, and it is easy to cause indentation and even cause trauma on the face of the wearer. The situation is particularly obvious when the respirator is worn for a long time.

FIG. 1 is a view of a respirator. Respirator 100 is an earloop respirator. In the example shown in the drawing, the first respirator 100 is a foldable earloop respirator. However, while FIG. 1 illustrates a respirator, it is expressly contemplated that embodiments herein may apply to other respiratory protection devices. In the manufacturing process of the first respirator 100, a formable nose piece (often metal, however other suitable materials are envisioned, including plastic coated metal wire, wire mesh and the like) is attached underneath the respirator cover web. Alternatively, it is common to place the nose piece on the exterior surface of a respirator main body 110, within area 120. When the first respirator 100 is worn, a lanyard 130 is hung on the left and right ears of the wearer, respectively.

It is intended that a user adjust respirator 100 so that the nose of the wearer is accommodated in by adjusting the formable nose piece such that area 120, and the exterior edge 150 conform to the skin surface topography of the face of the wearer to closely fit the periphery of the nose of the wearer, thus reducing or even eliminating the gap between the respirator and the nose of the wearer. A good seal between respirator 100 and the face of the wearer is important for safety concerns.

Figure 2B:
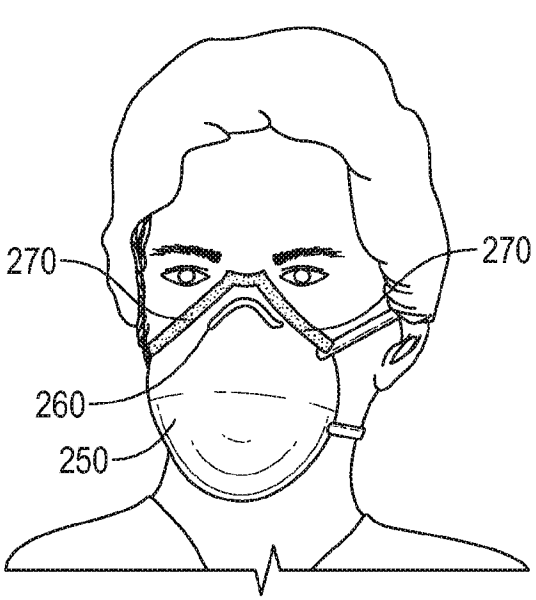
FIGS. 2A and 2B illustrate a respiratory protection device worn by a user in which embodiments of the present invention may be useful.
Figure 2A:
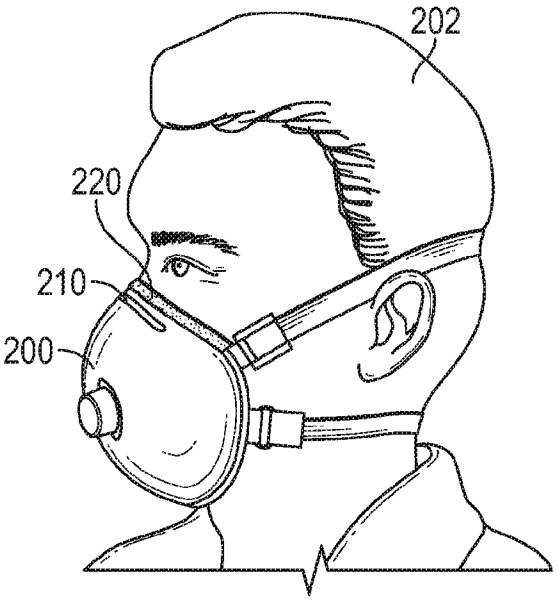

FIGS. 2A and 2B illustrate a respiratory protection device worn by a user in which embodiments of the present invention may be useful. As illustrated in FIGS. 2A and 2B, respiratory protection devices 200 and 250 can be secured over a user's face using a variety of methods other than the lanyard illustrated in FIG. 1.

Respiratory protection devices 200 and 250 are intended to work with a seal along portions 220 and 270. If an imperfect seal is present in portions 220, 270, then exhaled air may be forced upward, causing discomfort for some users, and may also cause respirators 200, 250 to move up or down along a nose of user 202. A user can adjust a nose clip 210, 260 to improve the fit of respirator 200, 250. However, it is often difficult for a user to get a nose clip 210, 260 into a good fit. For those who wear respiratory protection devices on a daily basis, this can cause irritation as a respiratory protection device rubs up and down on a user's skin. It also decreases the efficacy of the respiratory protection device.

Figure 3B:
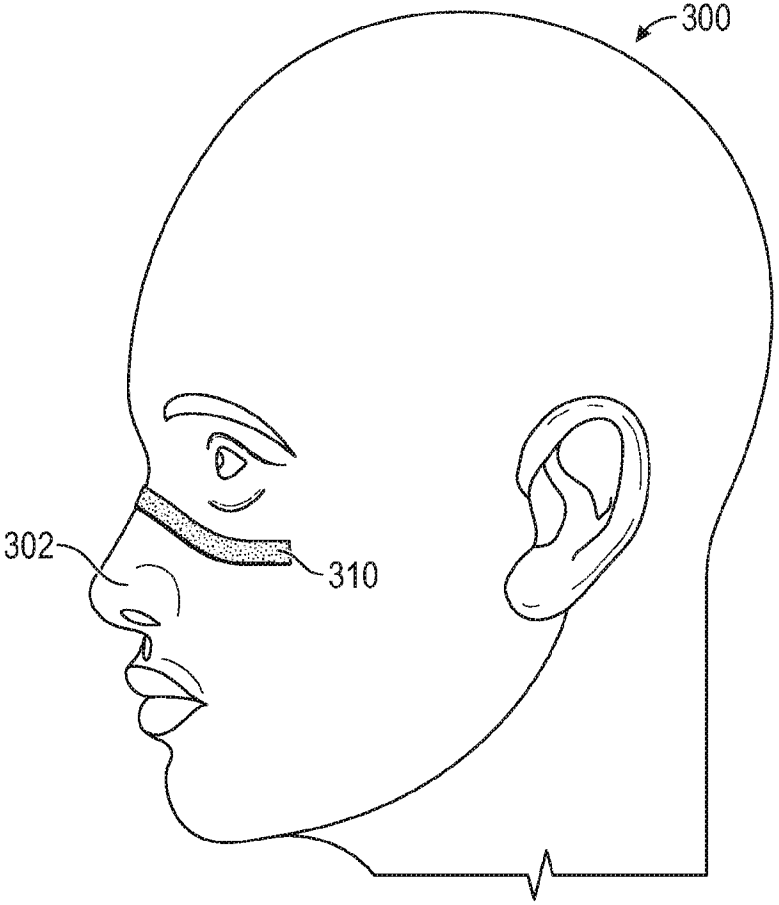
FIGS. 3A-3E illustrate facial topographies and placement of respiratory protection device on a face of a user.
Figure 3A:
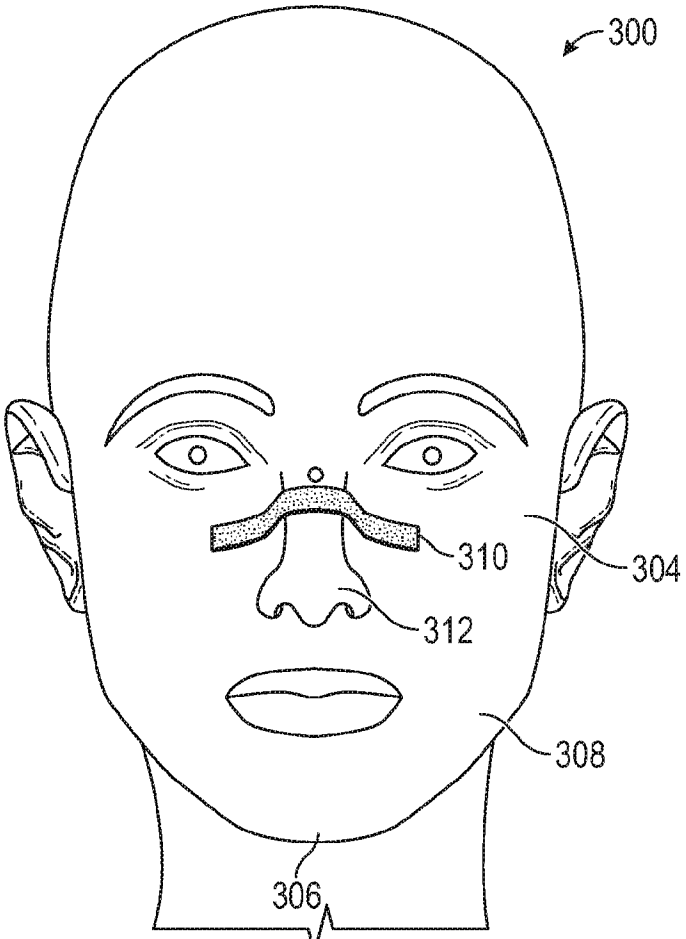

FIGS. 3A-3E illustrate facial skin surface topographies and placement of respirators on a face of a user. However, while FIGS. 3A-3E discuss respirator positioning, similar concerns arise for other respiratory protection devices. FIGS. 3A and 3B illustrate 3D images of an example user's face. User 300 has several facial areas that make their face unique. Many of these features can impact how a respirator fits the user. It is for these reasons that daily wearers of respirators should undergo annual fit tests and daily seal check to ensure that they have a particular product suitable for their features, for example position of cheek bones 304, chin 306, cheek profile 308 and nose 312.

For example, user 300 has a nose profile 302. A nose portion of a respirator, represented by bar 310 will sit somewhere along nose profile 302, as illustrated more clearly in FIGS. 3C-3E.

Figure 3C:
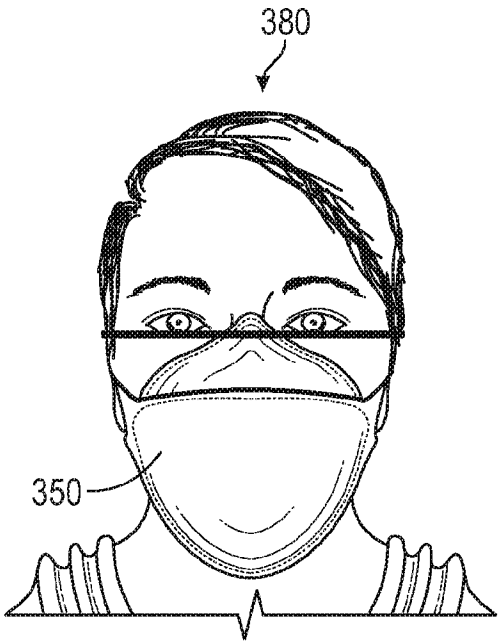
Figure 3D:
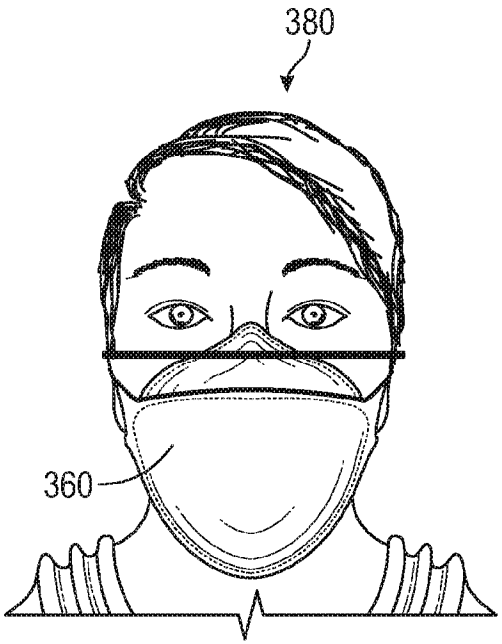
Figure 3E:
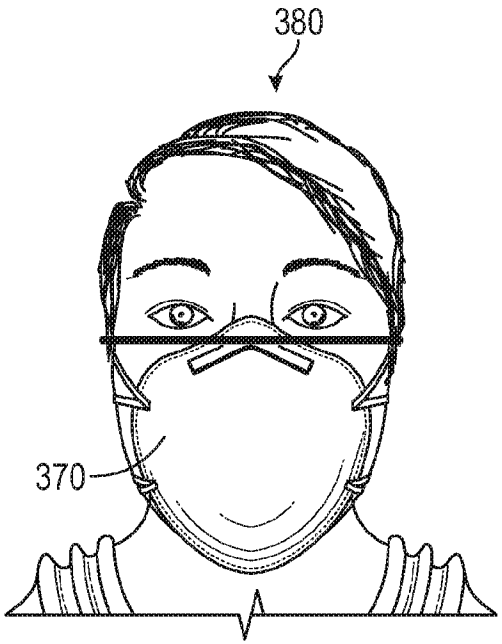

FIGS. 3C-3E illustrate how a single individual may interact with respirators differently. respirators 350 and 360 are the same model of respirator, illustrating how one user may have more than one potential preferred location. A different respirator 370, may be worn in a different position. The wearer may select a preferred position based on a number of factors including comfort, presence of glasses, goggles or other PPE, or the intended use, for example whether they will be talking significantly.

There exists a strong need for a way to customize a respirator for a user so that the respirator has an improved seal against the user's face, both for safety considerations and comfort. In the past, a nose clip has been added, often formed of metal, that can be manipulated by a user. However, while a user can manipulate a nose clip, it may be done after a fit test for the individual has been conducted (e.g. when individual 380 discards respirator 350 illustrated in FIG. 3C and applies respirator 360). User 380 may have passed a fit test with a respirator in position 350, and may fail the same fit test in position 360. It is desired to have a solution that assists individual 380 in maintaining safe and consistent use of respirators in day to day operation.

Systems and methods herein provide consistent custom form-fitting nose portions for respirators. Described herein, and illustrated in FIGS. 4 and 5, for example, are custom printed nose portion formers that are made based on an actual facial profile of an individual user, for a specific model of face mask or respirator. FIGS. 5-8 illustrate systems and methods for making custom nose portion formers for an individual. However, it is expressly contemplated that these are by example only and similar methods and systems may also fall within the scope of the inventive concepts herein.

Figure 4A:
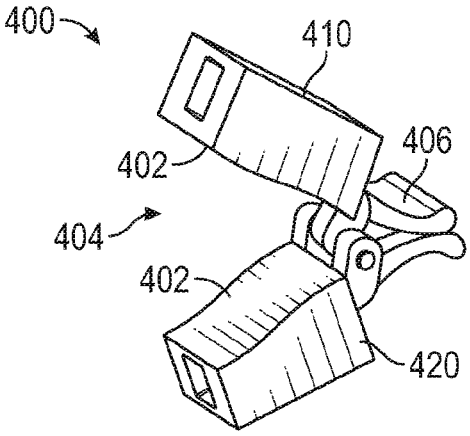
FIGS. 4A and 4B illustrate a nose portion former in accordance with embodiments herein.
Figure 4B:
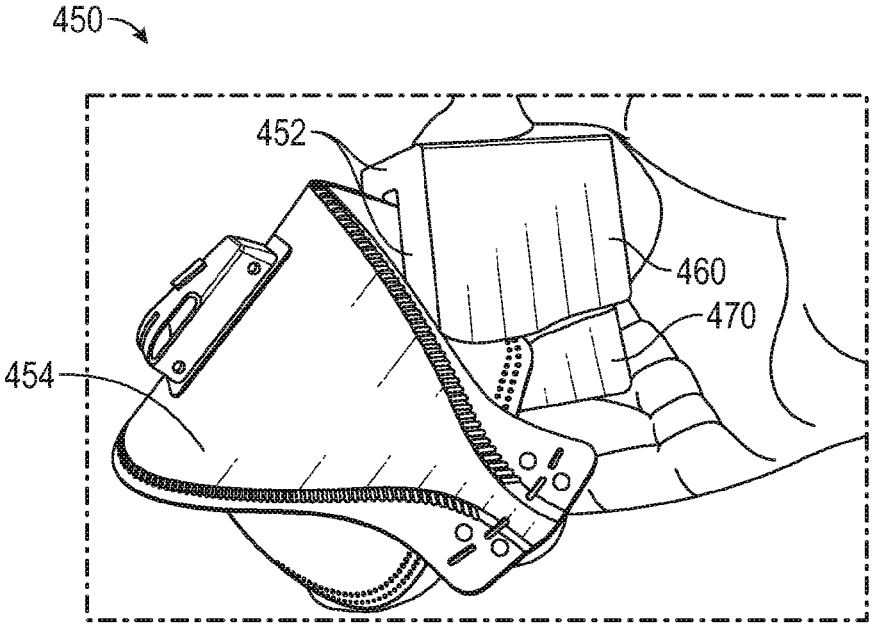

FIGS. 4A and 4B illustrate a nose portion former in accordance with embodiments herein. Nose portion former 400 performs a crimping action on a nose clip (metal or otherwise). Nose portion former 400, in the embodiment illustrated in FIG. 4A, has two portions, a top portion 410 and a bottom portion 420, connected by a connector 406. Connector 406 may be a mechanical connector, or may be an alignment mechanism that maintains a relative alignment of top portion 410 and bottom portion 420. Alignment mechanism may be a tongue and groove connection, a peg and hole connection, or another suitable connection. Or portions 410, 420 may not have a connection, as illustrated in FIG. 4B.

A nose portion of a respiratory protection device is inserted in between portions 410, 420, as illustrated by arrow 404. Portions 410 and 420 have matching contours 402, that are molded based on a facial scan of a wearer, such that contours 402 match the facial skin surface topography of a wearer in a desired position on their nose. As described in greater detail with respect to FIGS. 5-8, a user either selects a respiratory protection device or is provided a respiratory protection device recommendation. Wearing the respiratory protection device in a desired (or fit-test approved) position, a scan is taken of a user's face, to determine where on their face the respiratory protection device will sit. A scan is also taken of the user's face without the respiratory protection device, to capture a facial skin surface topography at the nose clip portion. Based on the captured facial skin surface topography, nose portion former 400 is manufactured, such that contour 402 matches the facial skin surface topography.

Nose portion former 400 is a custom tool that is designed to fit a particular respiratory protection device type and model to a particular individual. It is designed to impart the same contour 402 to each respirator insert along arrow 404, such that as an individual goes about their day, they will have a consistently well-fitting respirator.

Nose portion former 450 is illustrated in FIG. 4B. Respirator 454 is inserted between portion 460 and 470, each of which has a matching contour 452, which, during the crimping action, is being imparted onto a nose clip of respirator 454. Nose portion former 450 may have indicia, either written, indented, raised or that otherwise provides instructions to a user as to how far to insert respirator 454. However, while FIGS. 4A-4B are described with respect to a respirator 454, it is also expressly contemplated that embodiments of nose portion formers herein, including nose portion formers 400 and 450 may also be useful for other respiratory protection devices.

Figure 5:
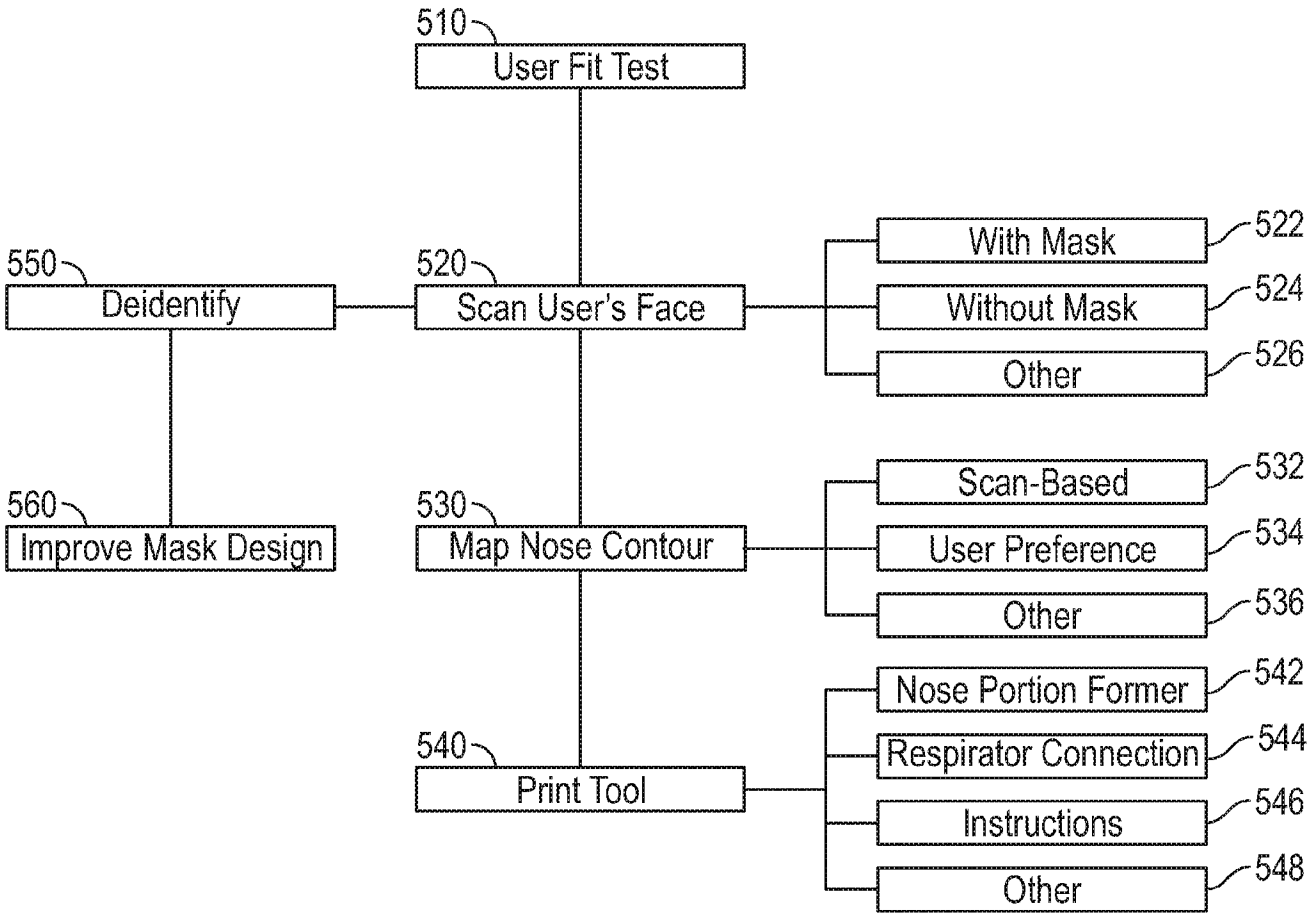
FIG. 5 illustrates a method of custom fitting a respiratory protection device to a face of a user in accordance with embodiments herein.

FIG. 5 illustrates a method of providing a custom fitting respiratory protection device for a face of a user in accordance with embodiments herein. Method 500 may be used to produce the nose portion formers illustrated in either FIG. 4A or 4B, or another component. For example, some respiratory protection device may have a custom connection feature that can have an improved fit if customized to a user's face.

In block 510, a user undergoes fit test for a particular respiratory protection device. In some embodiments, fit testing is done in accordance with OSHA standards according to an approved fit testing protocol. However, it is expressly contemplated that, in other embodiments, fit testing is just a user selecting a respiratory protection device they believe will be sufficient for a particular job. It is expressly contemplated that method 500 may be suitable for a retail environment, for example such that a user can obtain a nose portion former when purchasing a respiratory protection device of their choice, as well as an industrial or healthcare facility, such that an industrial hygienist conducts a regulatory approved fit test for a respirator.

In block 520, the user's face is scanned. Scanning may include imaging, such as with a camera. For example, a head on view or a side view may be taken, as illustrated in FIGS. 3A and 3B. Scanning may include taking a video of a user's face, from which individual frames may be analyzed. The scan may be taken of the user wearing a respiratory protection device, as indicated in block 522, without respiratory protection device, as indicated in block 524, or with other properties, as indicated in block 526. For example, the user may go through some steps to ensure that a fit is secure while wearing a respiratory protection device, for example smiling, frowning, laughing, yawning, walking, running, jumping or otherwise undertaking activities to ensure that the respiratory protection device will retain a fit.

It may be possible, in some embodiments, to scan either the face with a respiratory protection device, as in block 522, or without, as in block 524, and not obtain both scans. However, information about where a user prefers to wear their respiratory protection device can be obtained by scanning the user's face with the respiratory protection device on: and information about details such as nose shape, potential scarring or other features that may change how a respiratory protection device sits during use can be obtained only without the respiratory protection device being worn.

In block 530, the skin surface topography of a user is mapped. Mapping may be done by detecting an area on the bridge of a nose where the respirator will sit and mapping out the facial features. The skin surface topography may be mapped solely based on images taken of a user's face, as indicated in block 532, or based on some user preference, as indicated in block 534. For example, as indicated in FIGS. 3D and 3E, a user may choose to wear the same respiratory protection device in different positions. A skin surface topography may be mapped using other methods, as indicated in block 536.

In block 540, a tool is printed. The tool may be a nose portion former, as indicated in block 542, which may be printed to include a contour that matches the skin surface topography mapped in step 530. However, other tools may be printed based on a user's facial scan. For example, a respirator connector may be printed, as indicated in block 544. Additionally, instructions may be printed, or provided with the printed tool, as indicated in block 546. Other materials may be provided, as indicated in block 548.

Printing may include additive manufacturing methods, such as 3D printing. Alternatively, the contour may be carved out of a substrate, for example using a laser engraving tool to cut the contour out of a plastic or wooden blank. Alternatively, while printing is described as a mechanical process, it is also expressly contemplated that other alternatives are envisioned, such as the use of a hardening putty, compound or gel that can be applied to a user's face to obtain a sufficient contour match to the user's skin surface topography. The putty may then be incorporated into a nose portion forming tool.

The nose portion former is a reusable tool that, once it crimps the respirator into a custom-contoured respiratory protection device for a given user, can be stored until the user needs to custom-fit the next respiratory protection device they wear.

A system that performs method 500 may also be useful for providing information to PPE manufacturers for the purposes of designing better products.

In block 550, user facial scan information is deidentified. For example, only portions of the scan related to the lower face, e.g. the shape of a user's nose and mouth are pertinent to respiratory protection device manufacture. Therefore, other portions of the facial scan, such as eyes, ears or neck may be removed, or not stored in the first place.

In block 560, the deidentified information may be analyzed for providing improved respiratory protection device manufacture. For example, some respirator models may be determined to better fit some facial profiles over others. It may also be seen which way users default to wearing a given product, which may help to improve guidance to future users of said product.

In some embodiments, a nose portion former may be useful for multiple products. However, in some embodiments, a nose portion former is only good for a single product SKU.

In some embodiments, it may be possible for a nose portion former manufacturing system to obtain information about a mask, respirator or other facial covering product by reading a barcode or otherwise recognizing the product. Product specifications, such as the presence and dimensions of a nose clip within the respiratory protection device, sizing information and options may also be retrievable, for example, from a device memory.

Method 500 illustrates a fit test in step 510. However it is expressly contemplated that a fit test may be as informal as a user trying on a respiratory protection device and deciding it fits, to as formal as an annual OSHA-mandated fit test conducted by an industrial hygienist in the United States or the HSE body in the UK, or another suitable regulatory body. Additionally, method 500 may be incorporated into a fit testing process, for example such that while a user is getting their fit test pass card filled out, the nose portion former is being printed such that it is ready for use when the wearer is. In such embodiments, the face scans are obtained as part of the fit test process, e.g. the user without the respiratory protection device is scanned, then the fit test conducted, and then the scan taken with the respiratory protection device on.

While FIG. 5 describes a method for custom fitting a nose portion of a respiratory protection device to a user's face, it is expressly contemplated that method 500 may be useful for other facial covering products that have deformable nose clips, such as cloth face coverings, dust masks, etc.

Figure 6:
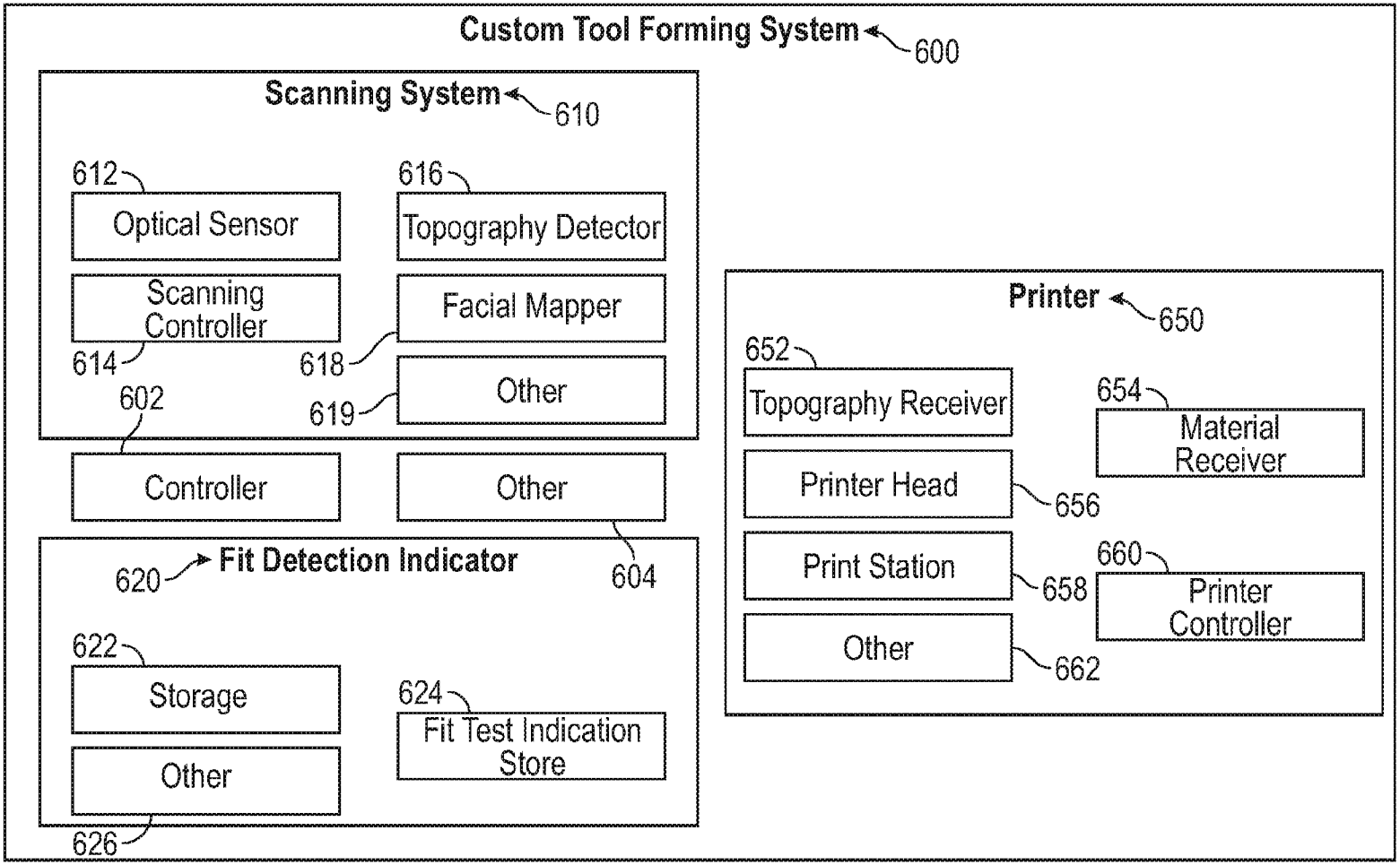
FIG. 6 illustrates a system for custom form-fitting a respiratory protection device to a wearer in accordance with embodiments herein.

FIG. 6 illustrates a system for generating a custom form-fitting tool for a wearer in accordance with embodiments herein. System 600 may be useful for forming a custom form-fitting nose portion former, or a respirator connection tool, or another PPE component that would benefit from a contour matching a skin surface topography of a wearer.

System 600 includes a scanning system 610. Scanning system 610 may, as illustrated in FIGS. 7A-7G, be contained within a computing device such as a mobile phone application, in some embodiments. In other embodiments, scanning system 610 may be incorporated into a booth or station either in an industrial setting or a retail establishment. Scanning system 610 includes an optical sensor 612 such as a 2D camera or video camera, or a 3D camera, or a system of cameras. Optical sensor 612 may also be, in other embodiments, a scattered light sensor, a laser-based sensing system such as LIDAR, or another suitable system. Based on the signals from optical sensor 612, a topography detector 616 detects a facial skin surface topography relevant to forming a custom-fit PPE component. Topography detector 616 may detect a facial skin surface topography based on light differences in the sensor signal indicative of facial skin surface topographies, in one embodiment or may detect facial skin surface topographies by comparative analysis to a database of faces, in one embodiment, or may utilize another suitable method.

Facial mapper 618, based on detected skin surface topography, maps the face of the user. In some embodiments, only topography portions relevant to the PPE being formed are mapped, e.g. the nose area for a nose portion former, or a nose and mouth area for a respirator seal. Facial mapper 618 may, for example, detect dimensions of the user's nose, particularly in the area where a respirator will sit. However, while the system of FIG. 6 is described herein with regard to customizing a respirator, it is expressly contemplated that such a system may also be useful for other facial covering products, such as cloth face masks, dust masks, etc.

Scanning system 610 may also include other functionality 619. For example, in embodiments where scanning system 610 includes an sensor 612 (such as a camera or other optical sensor, LIDAR or other laser-based sensor, etc.), other function 619 may include augmented reality overlay functionality that illustrates, for a user, where the respirator will sit on their face, or other pertinent information.

Scanning system 610 also includes a scanning controller 614 that controls operation of optical sensor 612, topography detector 616, facial mapper 618 and other functionality 619. For example, optical sensor 612 may only be powered on or activated to capture sensor signals when triggered, e.g. by motion, by user input, or another trigger, to conserve battery and processing power, in some embodiments.

Custom tool forming system 600 includes a fit detection indication 620, in some embodiments. For example, in an industrial setting, it may be necessary to retrieve information about what PPE a user has successfully passed a fit test for, and what they have not. For example, a healthcare worker may not be able to initiate a nose portion former manufacturing process for PPE they are not qualified to use, in some embodiments. In other embodiments, a user may be able to re-print a nose portion former without undergoing a scanning process, for example if scan data, skin surface topography data or facial mapping data is stored within storage 622. In some embodiments, a CAD, STL or other relevant printing file is stored in storage 622 for such retrieval. Indications of whether a user has passed a fit test, and which fit test, for example as specified by Appendix A to § 1910.134 FIT TESTING PROCEDURES (MANDATORY).

System 600 also includes a printer 650, a term used loosely to include rapid forming of a PPE component. Printing may include rapid additive manufacturing methods as well as subtractive manufacturing methods such as laser cutting, CNC machining or similar methods.

A topography receiver 652 receives details of the contour to be printed as part of the PPE component. Topography receiver 652 may receive a CAD file, STL file or other suitable instruction file. The file may be sent from scanning system 610, for example by controller 602. A file may also be received from storage 622, or from a remote storage source.

Topography receiver 652 may provide details to a printer head 656 at a printing station 658. Printing station 658 may assist in orienting or aligning printer head 656. In embodiments where printer head 656 is an additive manufacturing device, it may receive printing material from a material receiver 654, which may manage intake of printing material.

Printer 650 may be controlled by a printer controller 660, which may manage other functionality 662 of printer 650 as well.

Custom tool forming system 600 may also include other functionality 604, for example a communication component which may communicate scanning data, fit detection information, printing files, etc. to another source.

FIGS. 7A-7F illustrate user interfaces for a mobile application in accordance with embodiments herein. As discussed herein, the information needed for a custom fitting nose portion former may be collected using a mobile computing device, for example through an application on a mobile smartphone. FIGS. 7A-7F illustrate one example walkthrough of how such an application may be viewed by a user. However, it is expressly contemplated that FIGS. 7A-7F are merely one example embodiment.

Figure 7B:
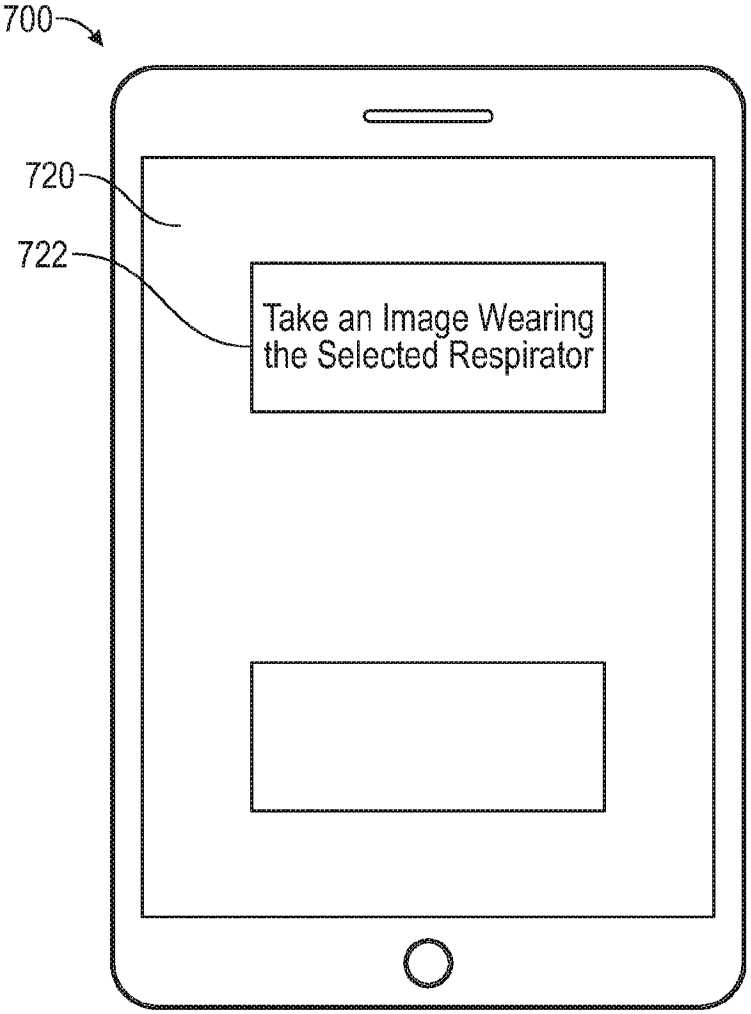
FIGS. 7A-7F illustrate user interfaces for a mobile application in accordance with embodiments herein.
Figure 7A:
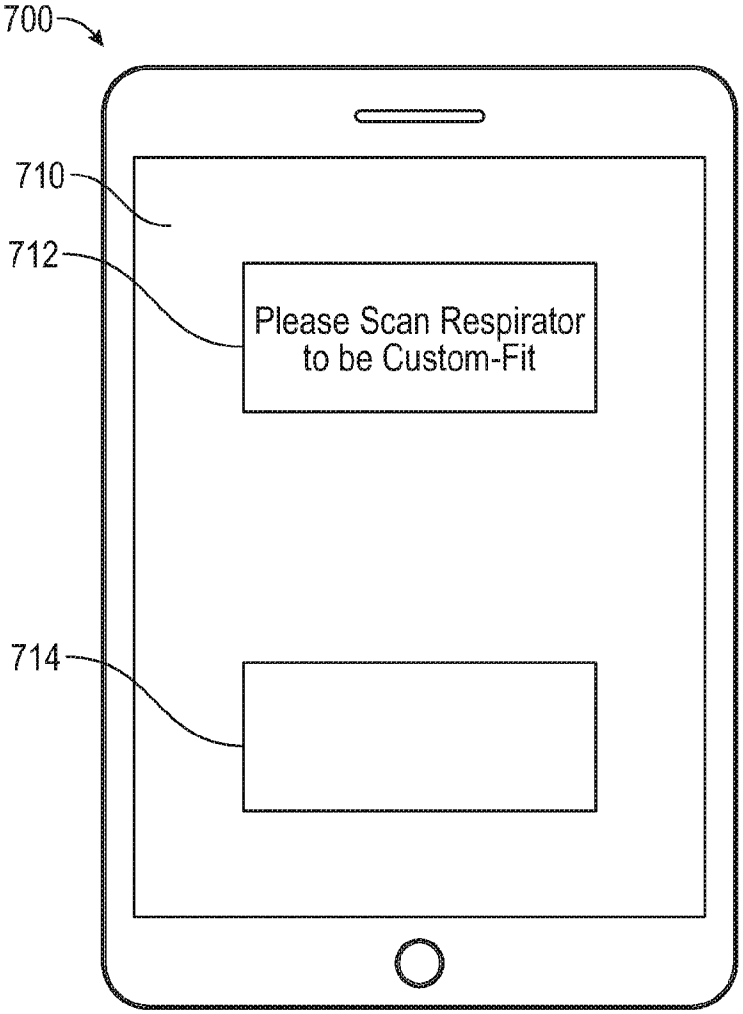

As illustrated in FIG. 7A, a user may start with a respiratory protection device already selected. In some embodiments, it is expressly contemplated that, based on a facial scan or fit test information, a particular model of PPE may be suggested. A mobile phone 700 may present a request 712, on a user interface 710, for the user to enter information about a selected PPE model. For example, a barcode reader 714 may be presented with the prompt, or a text box to enter a make or model of a selected respiratory protection device.

As illustrated in FIG. 7B, an image request 722 is presented on user interface 720. The request may be for a single image, or the application may guide the user into providing the images necessary to obtain sufficient facial mapping.

Figure 7D:
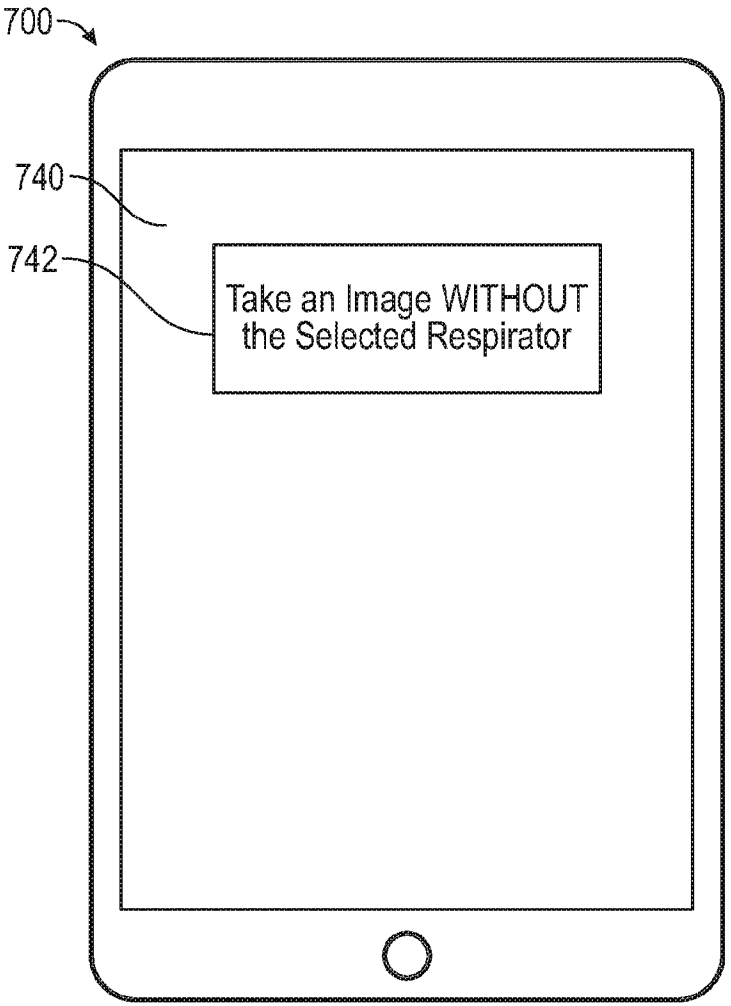
Figure 7C:
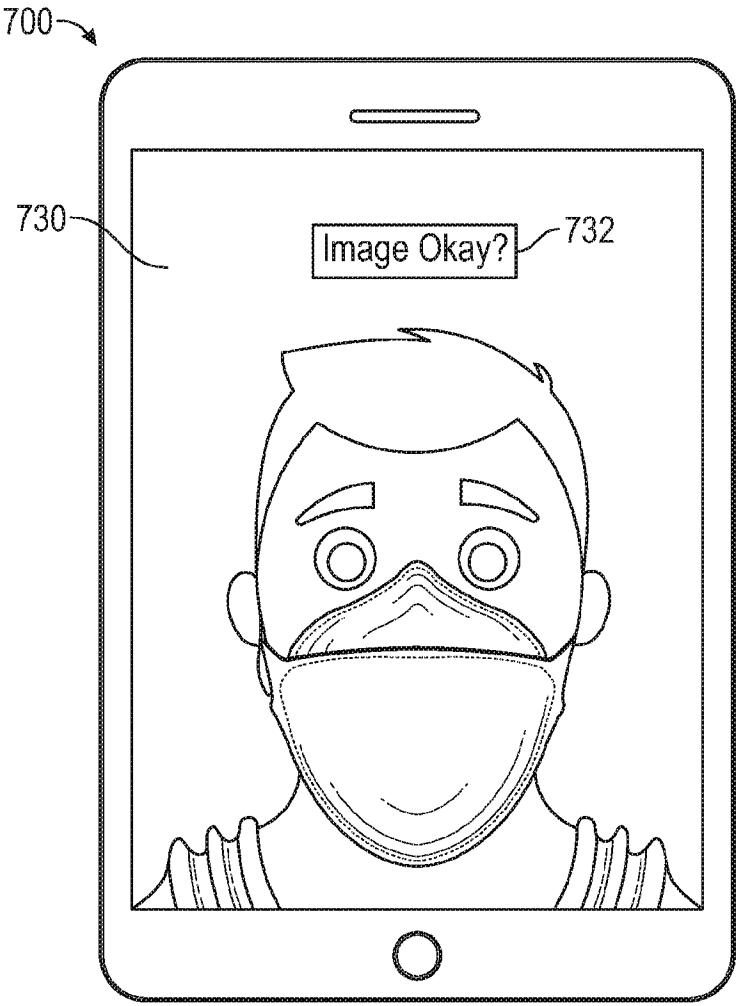

As illustrated in FIG. 7C, image approval 732 may be requested on a user interface 730, for example for a user to take a new photo if preferred. The system may automatically reject images, in some embodiments, that are too blurry or insufficient for mapping. As illustrated in FIG. 7C, it may be necessary to take an image of a user wearing a respiratory protection device. However, in some embodiments, only images of a user's face without a respiratory protection device are required. For example, in a retail setting it may be preferrable for a user to not need to open the respiratory protection device package or box prior to its purchase.

Figure 7E:
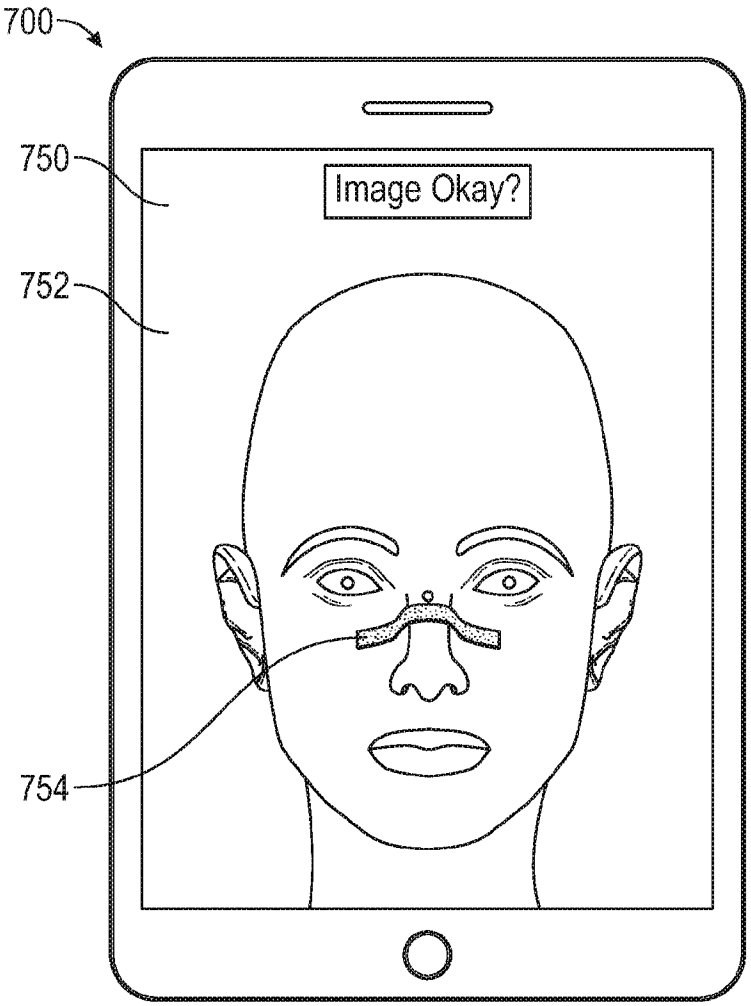

As illustrated in FIG. 7D, a prompt 742 may be presented on a user interface 740 for the user to take an image of their face without a respiratory protection device. As illustrated in FIG. 7E, the resulting image 752 may be presented to the user on a user interface 750. In some embodiments, an indication 754 is presented to show where the system has identified the nose clip of a respiratory protection device will rest. The user may be able to interact with indication 754 in some embodiments, e.g. moving it up or down on the bridge of the nose. In other embodiments, the user may only be able to indicate that the placement of indication 754 is correct or not.

Figure 7F:
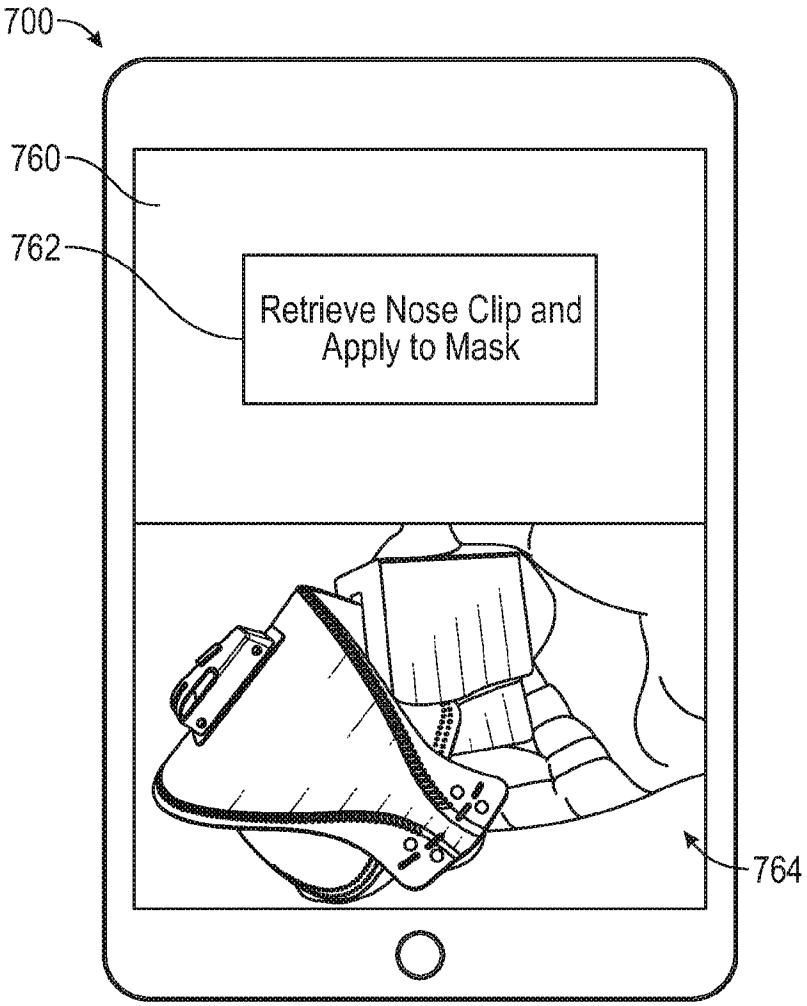

7F illustrates instructions 762 and pictoral prompts 764 on a user interface 760 that may assist a user in correctly using the PPE component, e.g. the nose portion former illustrated in FIG. 7F.

As illustrated in FIGS. 7A-7F, a user can rapidly create a reusable tool that can be used to custom-fit a respiratory protection device to fit the unique skin surface topography of the user's face. The reusable tool can be retained by the user, for example stored in a locker associated with the user, kept on a lanyard about the user's neck, or otherwise accessible so that, when the user discards a first respiratory protection device and obtains a second one, that the second one can also be custom-fit. The tool can be stored in the dispenser box for the respiratory protection devices, preferably in a separate compartment.

Figures 2, 8A:
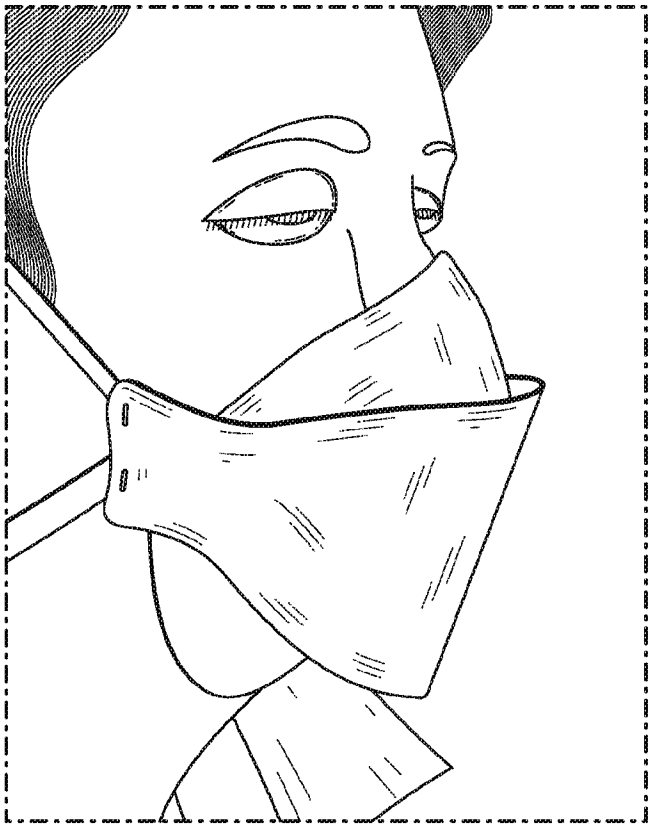
FIGS. 8A-8G illustrate steps of customizing a respiratory protection device in accordance with embodiments herein.
Figures 1, 8A:
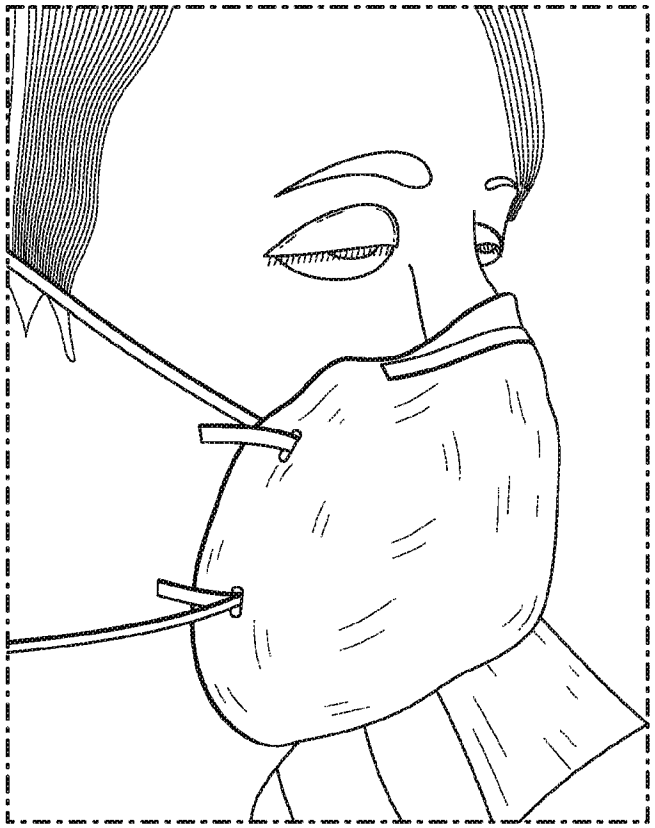
Figures 2, 8B:
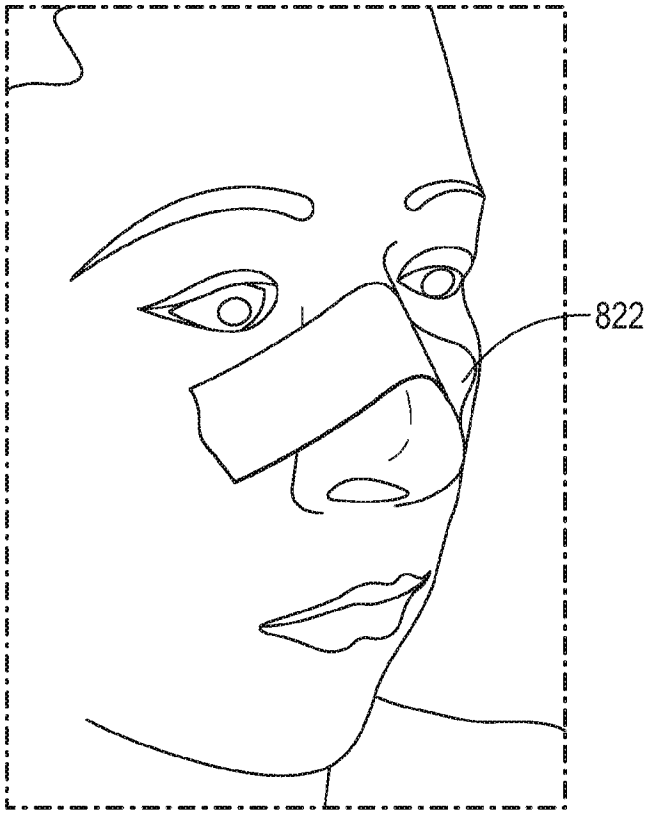
Figures 1, 8B:
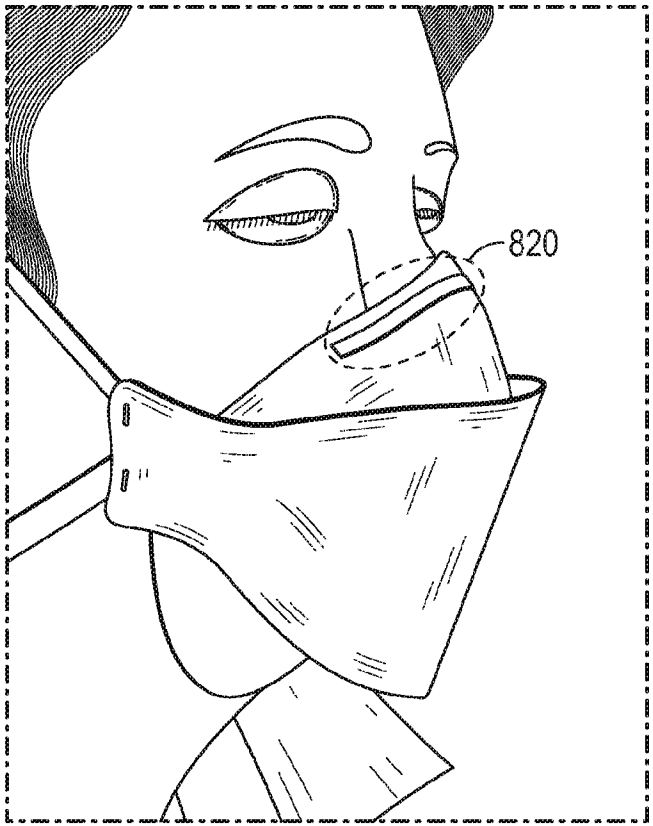
Figure 8C:
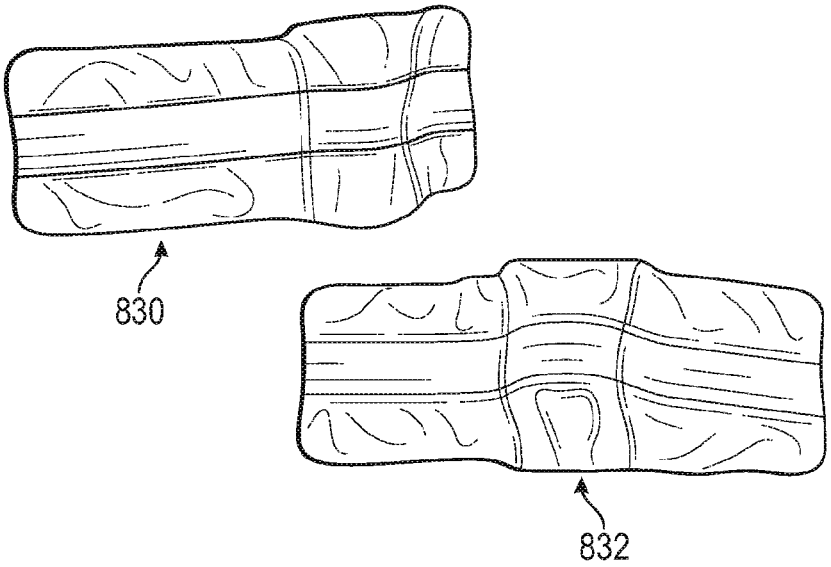
Figure 8D:
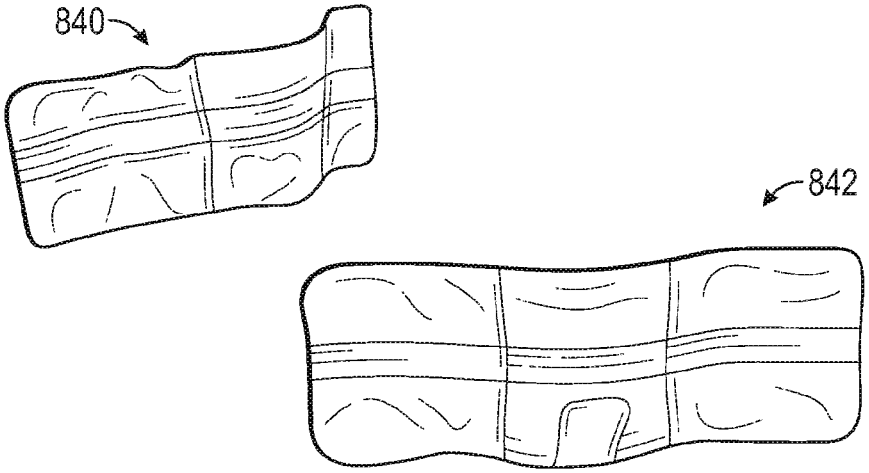

FIGS. 8A-8G illustrate steps of customizing a respiratory protection device in accordance with embodiments herein. FIGS. 8A-1 and 8A-2 illustrate 3D scans taken of a user's face wearing a 1860 Respirator (8A-1) and an Aura® Respirator (8A-2). As illustrated in FIGS. 8B-1 and 8B-2, once a scan of the user's face wearing the respirator is obtained, the nose area is replicated, as indicated by reference numerals 820 and 822.

From the skin surface topography detected in FIG. 8B-2, a nose clip former is generated. Top views 830 and 832 are presented in FIG. 8C and bottom views 840 and 842 are presented in FIG. 8D.

Figure 8E:
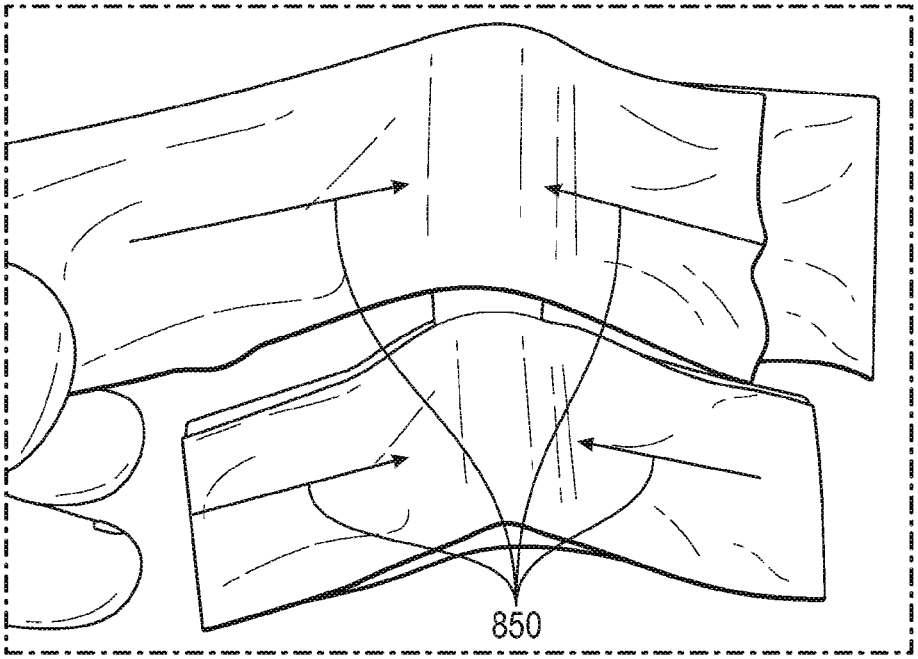

FIG. 8E illustrates operation of the nose clip. A respirator is slid, along the direction of arrows 850, such that the nose clip is centered within nose clip former and the contour of nose clip former is imparted to the nose clip of the respirator.

Figures 1, 8F:
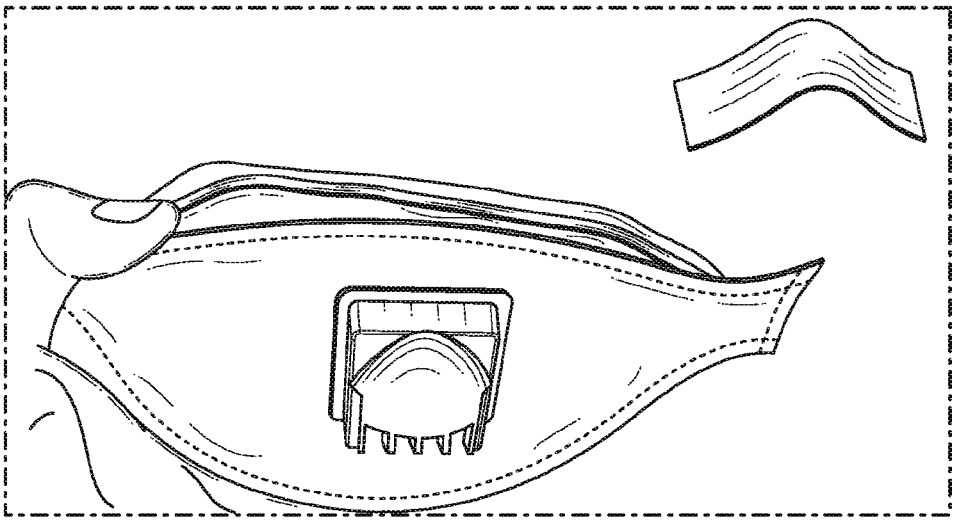
Figures 2, 8F:
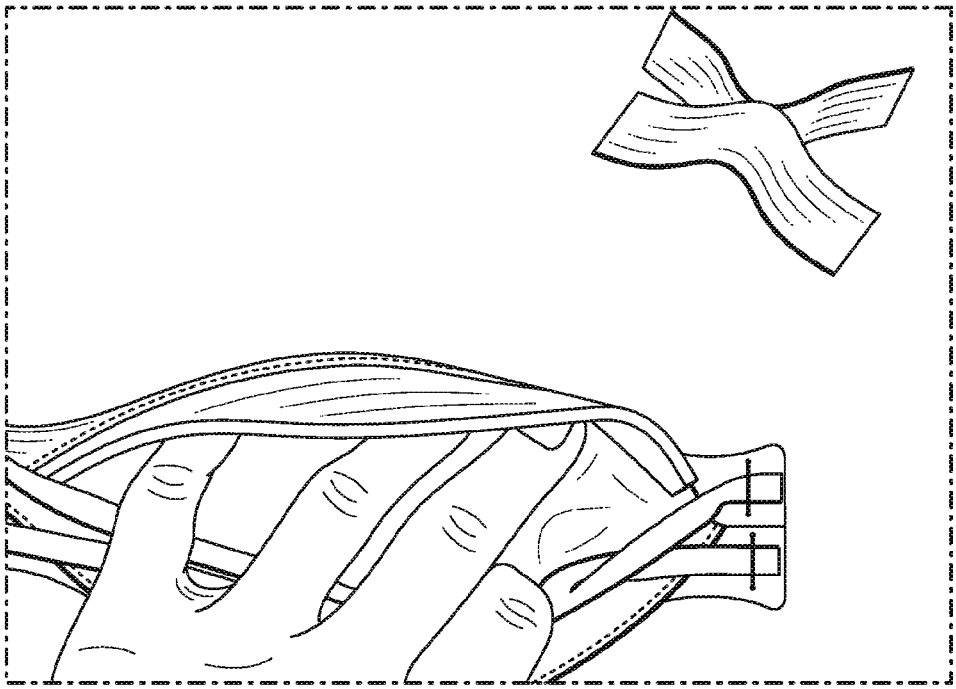
Figures 1, 8G:
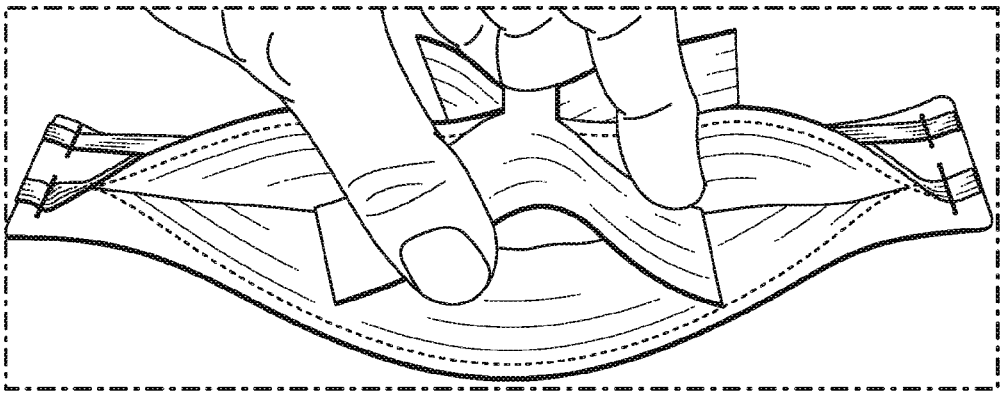
Figures 2, 8G:
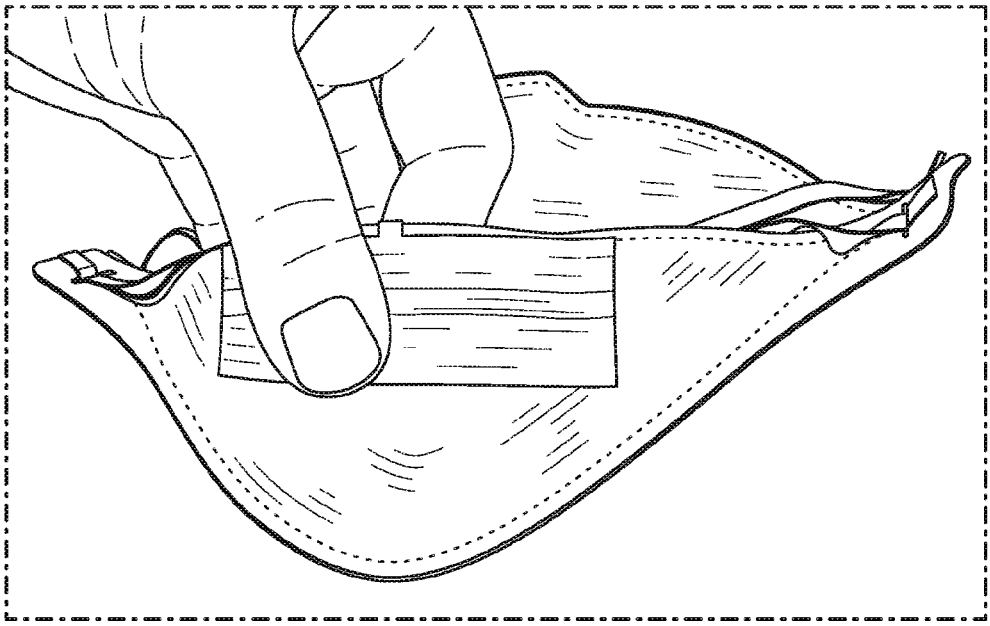

FIGS. 8F-1 and 8F-2 illustrate a newly opened, unformed respirator. As illustrated in FIG. 8G-1, the nose clip former is aligned with the metal nose clip on the respirator. This may be done by aligning the respirator with drawn indicators on the respirator, the tool, or both.

Figures 3, 8G:
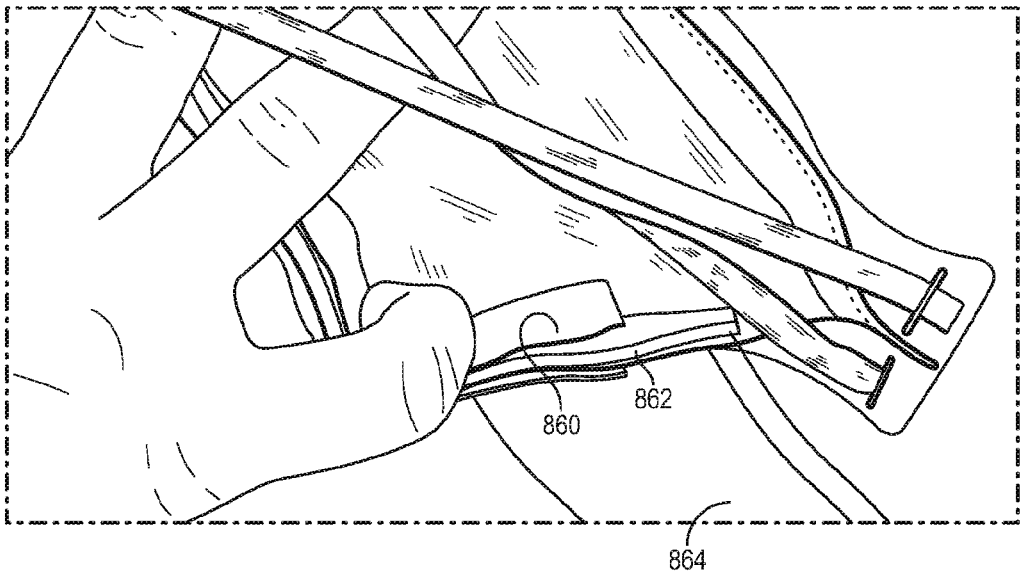

FIGS. 8G-2 and 8G-3 illustrate the aligned nose clip former custom forming the nose clip of the respirator to match the skin surface topography of the user's face. As illustrated in FIG. 8G-3, in some embodiments the nose portion former 860 does not extend the full length of a foam cushion 862, much less the length of respirator 864. However, it is expressly contemplated that, in some embodiments, nose portion former 860 extends long enough to impart a custom fit for a user's nose topography. Nose portion former 860 may have a width that differs from user to user, in some embodiments. While FIGS. 8A-8G illustrate a walkthrough of modifying a respirator, it is expressly contemplated that similar steps may be used to customize other respiratory protection devices, including cloth face masks, dust face masks, or other facial coverings with deformable nose features.

Figure 9:
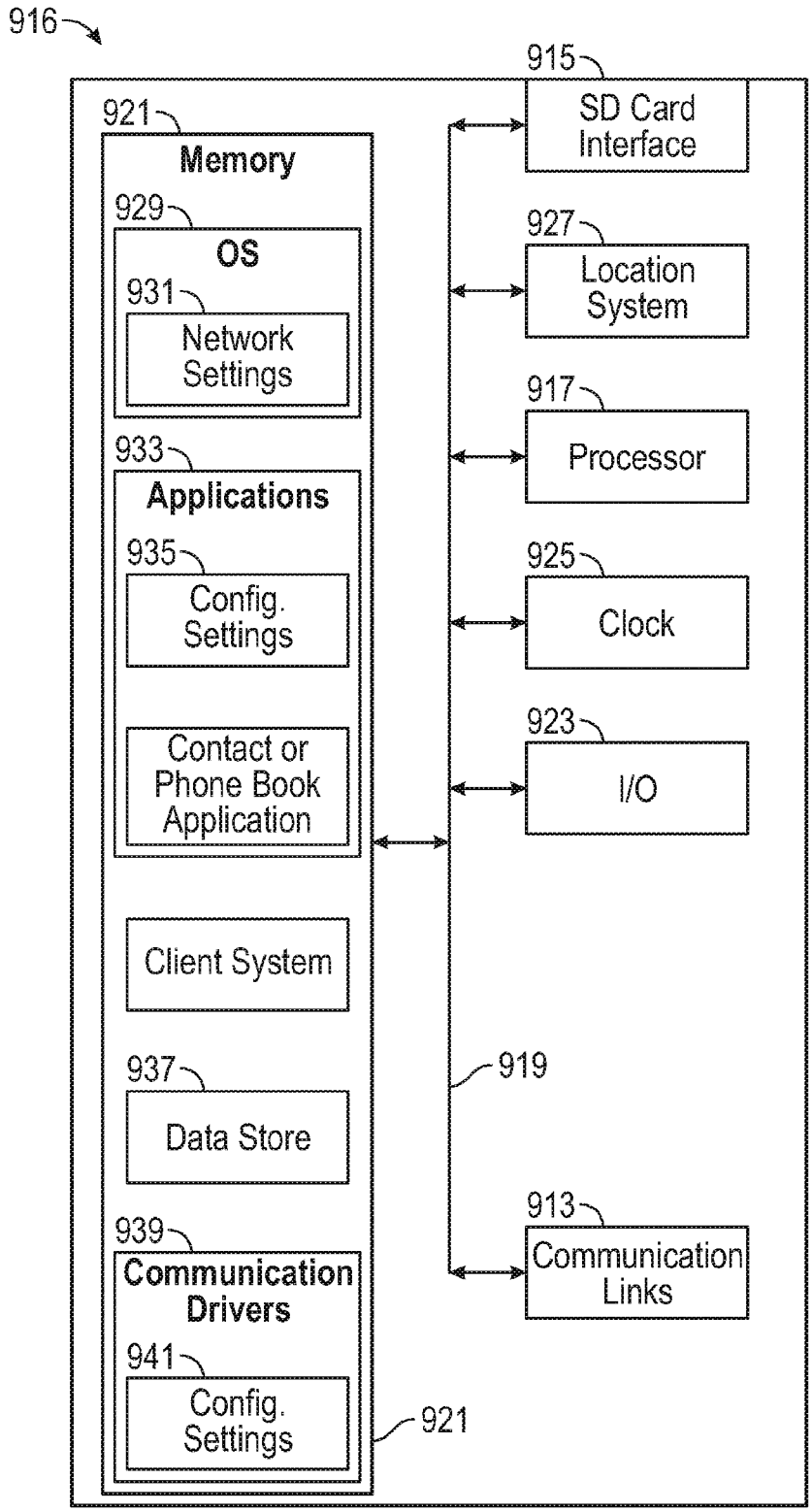
FIGS. 9-11 illustrate example devices that can be used in embodiments herein.
Figure 10:
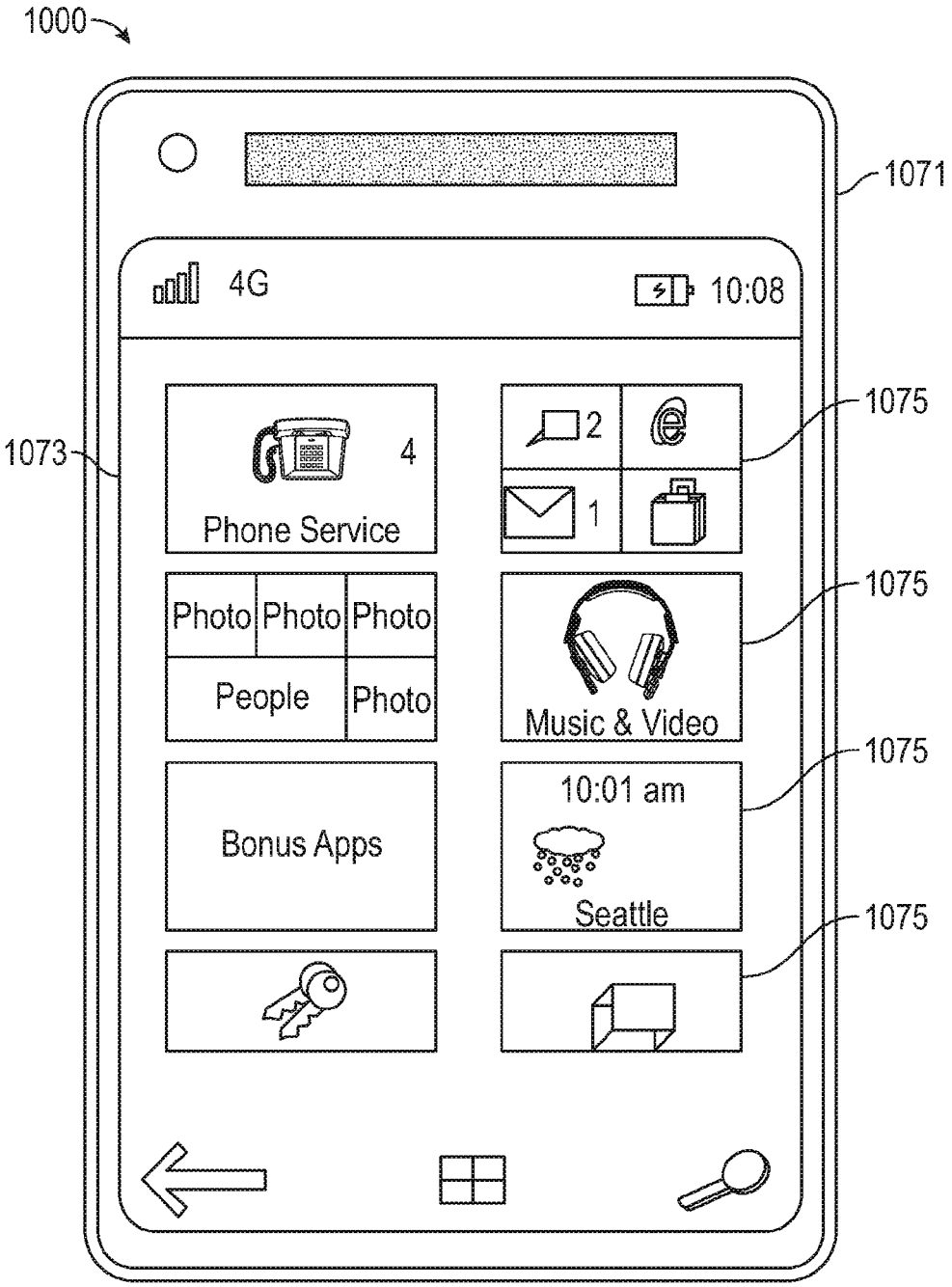
Figure 11:
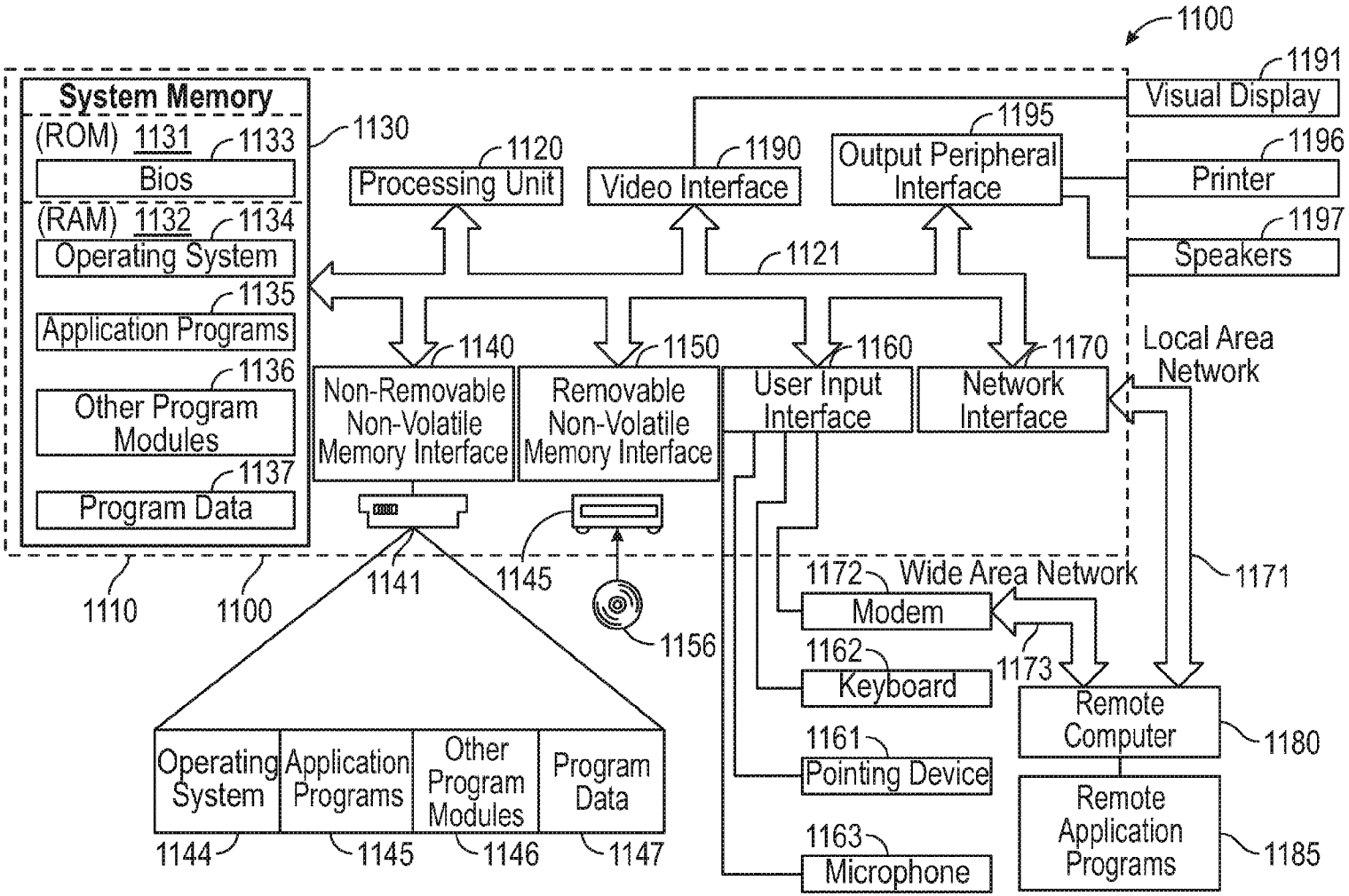

FIGS. 9-11 illustrate example devices that can be used in the embodiments shown in previous Figures. FIG. 9 illustrates an example mobile device that can be used in the embodiments shown in previous Figures. FIG. 9 is a simplified block diagram of one illustrative example of a handheld or mobile computing device that can be used as either a worker's device or a supervisor/safety officer device, for example, in which the present system (or parts of it) can be deployed. For instance, a mobile device can be deployed in the operator compartment of computing device for use in generating, processing, or displaying the data.

FIG. 9 provides a general block diagram of the components of a mobile cellular device 916 that can run some components shown and described herein. Mobile cellular device 916 interacts with them or runs some and interacts with some. In the device 916, a communications link 913 is provided that allows the handheld device to communicate with other computing devices and under some embodiments provides a channel for receiving information automatically, such as by scanning. Examples of communications link 913 include allowing communication though one or more communication protocols, such as wireless services used to provide cellular access to a network, as well as protocols that provide local wireless connections to networks.

In other examples, applications can be received on a removable Secure Digital (SD) card that is connected to an interface 915. Interface 915 and communication links 913 communicate with a processor 917 (which can also embody a processor) along a bus 919 that is also connected to memory 921 and input/output (I/O) components 923, as well as clock 925 and location system 927.

I/O components 923, in one embodiment, are provided to facilitate input and output operations and the device 916 can include input components such as buttons, touch sensors, optical sensors, microphones, touch screens, proximity sensors, accelerometers, orientation sensors and output components such as a display device, a speaker, and or a printer port. Other I/O components 923 can be used as well.

Clock 925 illustratively comprises a real time clock component that outputs a time and date. It can also provide timing functions for processor 917.

Illustratively, location system 927 includes a component that outputs a current geographical location of device 916. This can include, for instance, a global positioning system (GPS) receiver, a LORAN system, a dead reckoning system, a cellular triangulation system, or other positioning system. It can also include, for example, mapping software or navigation software that generates desired maps, navigation routes and other geographic functions.

Memory 921 stores operating system 929, network settings 931, applications 933, application configuration settings 935, data store 937, communication drivers 939, and communication configuration settings 941. Memory 921 can include all types of tangible volatile and non-volatile computer-readable memory devices. It can also include computer storage media (described below). Memory 921 stores computer readable instructions that, when executed by processor 917, cause the processor to perform computer-implemented steps or functions according to the instructions. Processor 917 can be activated by other components to facilitate their functionality as well. It is expressly contemplated that, while a physical memory store 921 is illustrated as part of a device, that cloud computing options, where some data and/or processing is done using a remote service, are available.

FIG. 10 shows that the device can also be a smart phone 1071. Smart phone 1071 has a touch sensitive display 1073 that displays icons or tiles or other user input mechanisms 1075. Mechanisms 1075 can be used by a user to run applications, make calls, perform data transfer operations, etc. In general, smart phone 1071 is built on a mobile operating system and offers more advanced computing capability and connectivity than a feature phone. Note that other forms of the devices are possible.

FIG. 11 is one example of a computing environment in which elements of systems and methods described herein, or parts of them (for example), can be deployed. With reference to FIG. 11, an example system for implementing some embodiments includes a general-purpose computing device in the form of a computer 1110. Components of computer 1110 may include, but are not limited to, a processing unit 1120 (which can comprise a processor), a system memory 1130, and a system bus 1121 that couples various system components including the system memory to the processing unit 1120. The system bus 1121 may be any of several types of bus structures including a memory bus or memory controller, a peripheral bus, and a local bus using any of a variety of bus architectures. Memory and programs described with respect to systems and methods described herein can be deployed in corresponding portions of FIG. 11.

Computer 1110 typically includes a variety of computer readable media. Computer readable media can be any available media that can be accessed by computer 1110 and includes both volatile/nonvolatile media and removable/non-removable media. By way of example, and not limitation, computer readable media may comprise computer storage media and communication media. Computer storage media is different from, and does not include, a modulated data signal or carrier wave. It includes hardware storage media including both volatile/nonvolatile and removable/non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by computer 1110. Communication media may embody computer readable instructions, data structures, program modules or other data in a transport mechanism and includes any information delivery media. The term "modulated data signal" means a signal that has one or more of its characteristics set or changed in such a manner as to encode information in the signal.

The system memory 1130 includes computer storage media in the form of volatile and/or nonvolatile memory such as read only memory (ROM) 1131 and random-access memory (RAM) 1132. A basic input/output system 1133 (BIOS) containing the basic routines that help to transfer information between elements within computer 1110, such as during start-up, is typically stored in ROM 1131. RAM 1132 typically contains data and/or program modules that are immediately accessible to and/or presently being operated on by processing unit 1120. By way of example, and not limitation, FIG. 10 illustrates operating system 1134, application programs 1135, other program modules 1136, and program data 1137.

The computer 1110 may also include other removable/non-removable and volatile/nonvolatile computer storage media. By way of example only, FIG. 11 illustrates a hard disk drive 1141 that reads from or writes to non-removable, nonvolatile magnetic media, nonvolatile magnetic disk 1152, an optical disk drive 1155, and nonvolatile optical disk 1156. The hard disk drive 1141 is typically connected to the system bus 1121 through a non-removable memory interface such as interface 1140, and optical disk drive 1155 are typically connected to the system bus 1121 by a removable memory interface, such as interface 1150.

Alternatively, or in addition, the functionality described herein can be performed, at least in part, by one or more hardware logic components. For example, and without limitation, illustrative types of hardware logic components that can be used include Field-programmable Gate Arrays (FPGAs), Application-specific Integrated Circuits (e.g., ASICs), Application-specific Standard Products (e.g., ASSPs), System-on-a-chip systems (SOCs), Complex Programmable Logic Devices (CPLDs), etc.

The drives and their associated computer storage media discussed above and illustrated in FIG. 11, provide storage of computer readable instructions, data structures, program modules and other data for the computer 1110. In FIG. 11, for example, hard disk drive 1141 is illustrated as storing operating system 1144, application programs 1145, other program modules 1146, and program data 1147. Note that these components can either be the same as or different from operating system 1134, application programs 1135, other program modules 1136, and program data 1137.

A user may enter commands and information into the computer 1110 through input devices such as a keyboard 1162, a microphone 1163, and a pointing device 1161, such as a mouse, trackball or touch pad. Other input devices (not shown) may include a joystick, game pad, satellite receiver, scanner, a gesture recognition device, or the like. These and other input devices are often connected to the processing unit 1120 through a user input interface 1160 that is coupled to the system bus but may be connected by other interface and bus structures. A visual display 1191 or other type of display device is also connected to the system bus 1121 via an interface, such as a video interface 1190. In addition to the monitor, computers may also include other peripheral output devices such as speakers 1197 and printer 1196, which may be connected through an output peripheral interface 1195.

The computer 1110 is operated in a networked environment using logical connections, such as a Local Area Network (LAN) or Wide Area Network (WAN) to one or more remote computers, such as a remote computer 1180. The computer may also connect to the network through another wired connection. A wireless network, such as WiFi may also be used.

When used in a LAN networking environment, the computer 1110 is connected to the LAN 871 through a network interface or adapter 1170. When used in a WAN networking environment, the computer 1110 typically includes a modem 1172 or other means for establishing communications over the WAN 1173, such as the Internet. In a networked environment, program modules may be stored in a remote memory storage device. FIG. 11 illustrates, for example, that remote application programs 1185 can reside on remote computer 1180.

In the present detailed description of the preferred embodiments, reference is made to the accompanying drawings, which illustrate specific embodiments in which the invention may be practiced. The illustrated embodiments are not intended to be exhaustive of all embodiments according to the invention. It is to be understood that other embodiments may be utilized and structural or logical changes may be made without departing from the scope of the present invention. The following detailed description, therefore, is not to be taken in a limiting sense, and the scope of the present invention is defined by the appended claims.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

If implemented in software, the techniques may be realized at least in part by a computer-readable medium comprising instructions that, when executed in a processor, performs one or more of the methods described above. The computer-readable medium may comprise a tangible computer-readable storage medium and may form part of a computer program product, which may include packaging materials. The computer-readable storage medium may comprise random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The computer-readable storage medium may also comprise a non-volatile storage device, such as a hard-disk, magnetic tape, a compact disk (CD), digital versatile disk (DVD), Blu-ray disk, holographic data storage media, or other non-volatile storage device.

The term "processor," as used herein may refer to any of the foregoing structure or any other structure suitable for implementation of the techniques described herein. In addition, in some aspects, the functionality described herein may be provided within dedicated software modules or hardware modules configured for performing the techniques of this disclosure. Even if implemented in software, the techniques may use hardware such as a processor to execute the software, and a memory to store the software. In any such cases, the computers described herein may define a specific machine that is capable of executing the specific functions described herein. Also, the techniques could be fully implemented in one or more circuits or logic elements, which could also be considered a processor.

Here, the exemplary embodiments of the present invention have been described in detail, but it should be understood that the present invention is not limited to the specific embodiments described and illustrated in detail above. Those skilled in the art can make various variations and variants of the present invention without departing from the gist and scope of the present invention. All these variations and variants fall within the scope of the present invention. Moreover, all components described here can be replaced by other technically equivalent components.

A custom nose portion former for a respiratory protection device is presented. The former comprises a first portion comprising a nose contour. The nose contour matches a facial skin surface topography of a user of the respiratory protection device. The former comprises a second portion. When the first portion and the second portion, when engaged around a deformable nose portion within the respiratory protection device, form it to match first nose contour such that the face mask is custom fit to the user.

The custom nose portion former may be implemented such that the respiratory protection device is a respirator.

The custom nose portion former may be implemented such that the custom portion former comprises a polymer.

The custom nose portion former may be implemented such that the custom portion former comprises a 3D printed polymer.

The custom nose portion former may be implemented such that the 3D printed polymer comprises a plastic or a resin.

The custom nose portion former may be implemented such that the first portion is configured to contact an exterior of the respiratory protection device, and the second portion is configured to contact an interior of the respiratory protection device.

The custom nose portion former may be implemented such that the first portion is configured to contact an interior of the respiratory protection device, and the second portion is configured to contact an exterior of the respiratory protection device.

The custom nose portion may be implemented such that the nose contour comprises a concave portion.

The custom nose portion may be implemented such that the custom nose portion is formed based in part on the selected respiratory protection device.

The custom nose portion may be implemented such that the custom nose portion is formed based in part on the position of the deformable nose clip within the respiratory protection device.

The custom nose portion may be implemented such that the first portion has a width selected based on a length of the deformable nose clip.

The custom nose portion may be implemented such that the first portion has a width less than the length of the deformable nose clip.

The custom nose portion may be implemented such that the first portion has a width longer than the length of the deformable nose clip.

The custom nose portion may be implemented such that the respiratory protection device is disposable.

The custom nose portion may be implemented such that the first portion comprises a first alignment feature, the second portion comprises a second alignment feature, and the first and second alignment features interact to maintain alignment between the first and second portions when engaged around the deformable nose clip.

The custom nose portion may be implemented such that the first and second alignment features comprise hinge components.

The custom nose portion may be implemented such that the first and second alignment features comprise an aperture and a protrusion that is received by the aperture.

The custom nose portion may be implemented such that the nose contour matches a bridge of a nose of the user.

The custom nose portion may be implemented such that the nose contour matches a shape of a nasal bone of the user.

The custom nose portion may be implemented such that the nose contour matches a shape of a cartilage structure of a nose of the user.

The custom nose portion may be implemented such that the nose contour comprises a rounded portion.

The custom nose portion may be implemented such that the nose contour comprises an elliptical portion.

The custom nose portion may be implemented such that the deformable nose portion comprises a deformable nose clip.

The custom nose portion may be implemented such that the respiratory protection device is a face covering comprising a cloth layer.

The custom nose portion may be implemented such that the face covering comprises an incomplete seal.

A method of custom fitting a respiratory protection device to a face of a user is presented that includes scanning the face of the user using an optical sensor. The method also includes mapping a skin surface topography of the user based on a scanning dataset. The method also includes forming a nose portion former, based on the mapped skin surface topography. The nose portion former comprises an edge that has a matching contour to the mapped skin surface topography. The method also includes providing instructions to the user for forming a custom-fit nose portion of the respiratory protection device. The instructions include the user aligning a deformable nose clip of the respiratory protection device with the nose portion former and pressing the matching contour into the nose clip.

The method may be implemented such that scanning the face of the user comprises scanning the bare face of the user, and scanning the face of the user while the user is wearing the respiratory protection device.

The method may also include receiving a respiratory protection device indication regarding the respiratory protection device.

The method may be implemented such that the mask indication is a respiratory protection device type, respiratory protection device model, nose clip material, nose clip dimensions, or respiratory protection device material.

The method may be implemented such that the respiratory protection device indication is received from the scanning dataset.

The method is implemented such that the optical sensor is a 2D scanner, a 3D scanner, or a camera.

The method may also include receiving a fit test indication for the respiratory protection device.

The method may also include providing instructions to the user for performing a fit test for the custom-fit respiratory protection device.

The method may be implemented such that the nose portion former comprises a first portion and a second portion. The first portion comprises the edge. Pressing comprises pressing the first and second portions together around the respiratory protection device.

The method may be implemented such that aligning comprises the user placing the deformable nose clip of the respiratory protection device between the first and second portions, in an alignment position.

The method may be implemented such that the alignment position is indicated by indicia on the nose portion former.

The method may be implemented such that the scanning dataset comprises an image of a face of the user.

The method may be implemented such that the scanning dataset comprises a video of the user.

The method may be implemented such that mapping the skin surface topography comprises identifying a facial feature and, based on that facial feature, mapping a facial skin surface topography.

The method may also include saving the scanned dataset.

The method of may be implemented such that saving comprises deidentifying the scanned dataset and storing the deidentified scanning dataset.

The method may be implemented such that forming the nose portion former comprises a rapid printing technique.

The method may be implemented such that the rapid printing technique is additive manufacturing.

The method may be implemented such that the rapid printing technique is subtractive manufacturing.

The method may be implemented such that forming comprises generating a 3D image file of the nose portion former.

The method may be implemented such that the method further comprises storing the generated 3D image file.

The method may be implemented such that the method further comprises sending the 3D image file to a rapid printing machine.

The method may be implemented such that the custom portion former comprises a 3D printed polymer, a plastic or a resin.

The method may be implemented such that the first portion is configured to contact an exterior of the respiratory protection device, and the second portion is configured to contact an interior of the respiratory protection device.

The method may be implemented such that the first portion is configured to contact an interior of the respiratory protection device, and the second portion is configured to contact an exterior of the respiratory protection device.

The method may be implemented such that the nose contour comprises a concave portion.

The method may be implemented such that the custom nose portion is formed based in part on the position of the deformable nose clip within the respiratory protection device.

The method may be implemented such that the nose portion former has a width selected based on a length of the deformable nose clip.

The method may be implemented such that the nose portion former has a width less than the length of the deformable nose clip.

The method may be implemented such that the nose portion former has a width longer than the length of the deformable nose clip.

The method may be implemented such that the first portion comprises a first alignment feature, the second portion comprises a second alignment feature, and the first and second alignment features interact to maintain alignment between the first and second portions when engaged around the deformable nose clip.

The method may be implemented such that the first and second alignment features comprise hinge components.

The method may be implemented such that the first and second alignment features comprise an aperture and a protrusion that is received by the aperture.

The method may be implemented such that the contour matches a bridge of a nose of the user.

The method may be implemented such that the contour matches a shape of a nasal bone of the user.

The method may be implemented such that the contour matches a shape of a cartilage structure of a nose of the user.

The method may be implemented such that the respiratory protection device is a respirator.

The method may be implemented such that the respiratory protection device is a face covering comprising a cloth layer.

The method may be implemented such that the face covering comprises an incomplete seal.

A system for form-fitting a respiratory protection device to a wearer is presented. The system also includes a scanning system comprising an optical scanner that scans a facial topography of a user of the respiratory protection device. The system also includes a nose portion crimper builder that receives a scan dataset of the facial topography and forms a nose portion crimper with a matching contour. When the nose portion crimper is applied to a deformable nose clip of the respiratory protection device, it imparts the facial topography such that the respiratory protection device is custom fit to the user.

The system may also include a fit test indication receiver that receives an indication that the user has passed a fit test for the respiratory protection device.

The system may also include a mask indication receiver that receives a respiratory protection device indication. The respiratory protection device indication is a brand, a model, a respiratory protection device type, a deformable nose clip material, or a deformable nose clip dimension.

The system may be implemented such that the scanning system is configured to scan the bare face of the user to obtain a bare-face scan and scan the face of the user while the user is wearing the respiratory protection device to obtain a covered-face scan. The scan dataset comprises the bare-face scan and the covered-face scan.

The system may be implemented such that the respiratory protection device indication is received from the scanning dataset.

The system may be implemented such that the optical sensor is a 2D scanner, a 3D scanner, or a camera.

The system may also include an instruction generation module that generates instructions for the user for using the nose portion crimper.

The system may be implemented such that the instructions comprise alignment indications on the nose portion crimper.

The system may be implemented such that the instructions are provided to a user interface generation component that presents the instructions on a user interface.

The system may be implemented such that the nose portion crimper comprises a first portion and a second portion. The first portion comprises the matching contour. Applying the nose portion crimper comprises pressing the first and second portions together around the deformable nose clip.

The system may be implemented such that the nose portion crimper comprises an alignment indication such that pressing comprises the user placing the deformable nose clip between the first and second portions, in an alignment position indicated by the alignment indication.

The system may also include a topography detector that, based on the scan dataset, detects the facial topography and generates the matching contour.

The system may also include a facial mapper that maps a face of the user based on the detected facial topography.

The system may also include a dataset exporter that exports the mapped facial topography. The exported mapped face is deidentified.

The system may also include a storage component that stores the matching contour.

The system may be implemented such that the nose portion crimper former comprises a rapid printer.

The system may be implemented such that the nose portion crimper former is an additive manufacturing system.

The system may be implemented such that the nose portion crimper former is a subtractive manufacturing system.

The system may be implemented such that the system generates a 3D image file of the nose portion crimper.

The system may also include a storage module that stores the generated 3D image file.

The system may be implemented such that the nose portion crimper comprises a 3D printed polymer, a plastic or a resin.

The system may be implemented such that the first portion is configured to contact an exterior of the respiratory protection device, and the second portion is configured to contact an interior of the respiratory protection device.

The system may be implemented such that the first portion is configured to contact an interior of the respiratory protection device, and the second portion is configured to contact an exterior of the respiratory protection device.

The system may be implemented such that the matching contour comprises a concave portion.

The system may be implemented such that the nose portion crimper is formed based in part on the position of the deformable nose clip within the respiratory protection device.

The system may be implemented such that the nose portion crimper has a width selected based on a length of the deformable nose clip.

The system may be implemented such that the nose portion crimper has a width less than the length of the deformable nose clip.

The system may be implemented such that the nose portion crimper has a width longer than the length of the deformable nose clip.

The system may be implemented such that the first and second portions are coupled by a hinge.

The system may be implemented such that the first and second portions comprise an aperture and a protrusion that is received by the aperture.

The system may be implemented such that the respiratory protection device is a respirator.

The system may be implemented such that the respiratory protection device is a face covering comprising a cloth layer.

A form-fitted respirator comprising a custom fit nose portion is presented. The custom-fit nose portion is formed by positioning a nose portion of a respirator in an alignment position with respect to a nose portion former, wherein the nose portion former comprises a contour. The contour matches a facial topography of a wearer. The nose portion is further formed by pressing the nose portion former against the nose portion of the respirator to form the custom fit nose portion, wherein the custom-fit nose portion comprises the contour.

The form-fitted respirator may be implemented such that the nose portion former comprises a first portion and a second portion. The first portion comprises the edge, and pressing comprises pressing the first and second portions together around the respirator.

The form-fitted respirator may be implemented such that aligning comprises the user placing a deformable nose clip of the respirator between the first and second portions, in an alignment position.

The form-fitted respirator may be implemented such that the alignment position is indicated by indicia on the nose portion former.

The form-fitted respirator may be implemented such that the nose portion former is based on a scan of the facial topography of the wearer.

The form-fitted respirator may be implemented such that the nose portion former is formed using a rapid printing technique.

The form-fitted respirator may be implemented such that the rapid printing technique is additive manufacturing.

The form-fitted respirator may be implemented such that the rapid printing technique is subtractive manufacturing.

The form-fitted respirator may be implemented such that the first portion is configured to contact an exterior of the respirator, and the second portion is configured to contact an interior of the respirator.

The form-fitted respirator may be implemented such that the first portion is configured to contact an interior of the respirator, and the second portion is configured to contact an exterior of the respirator.

The form-fitted respirator may be implemented such that the nose contour comprises a concave portion.

The form-fitted respirator may be implemented such that the custom nose portion is formed based in part on the position of a deformable nose clip within the respirator.

The form-fitted respirator may be implemented such that the nose portion former has a width selected based on a length of a deformable nose clip within the respirator.

The form-fitted respirator may be implemented such that the first portion comprises a first alignment feature, the second portion comprises a second alignment feature, and the first and second alignment features interact to maintain alignment between the first and second portions when engaged around the deformable nose clip.

EXAMPLES

Example 1

1. Wearer goes through fit test and receives a Pass for that disposable respirator model.
2. User is asked if they would like a printed 3M® Nose Mold Guide.
3. If the user says yes, they open the 3M® Nose Mold Guide application on a mobile device.
4. The application scans the wearer's face, with the fitted respirator on (either reconstructing the face with 2D images, or using a depth sensor for a 3D map). The application also scans for the disposable respirator model (e.g. Aura 1873V+).
5. The application generates the complementary shape around the respirator on the outside of the nose plus disposable respirator, and the inside of the nose plus disposable respirator, adding a thin hinge between the two halves (or adding matching peg and holes on each side, to allow the user to reliably connect the two molds at the correct spot).
6. The application looks for the exact placement of the nose clip metal and adds raised or embedded arrows on either side of the nose clip, pointing to where the nose clip should be placed, on both sides of the nose mold.
7. The application adds 3M® logo, disposable respirator model number, and brief instructions to the outside of one half of the nose mold: optionally, it also prints the user's first name on the outside of the nose mold.
8. The application sends the nose guide model to a 3D printer, where it is printed. The user receives their nose guide mold and can use it to properly form their disposable respirator nose clip until they can reliably form it alone.

Example 2

1. Wearer decides to get a printed 3M® Nose Mold Guide and opens an application on a smartphone to create one.
2. The application scans the wearer's face, without the respirator on, to get exact nose and face shape measurements.
3. The user is told to put the disposable respirator on, without altering the nose clip. The user is advised to adjust the disposable respirator until it sits comfortably on their face (optionally with some additional donning guidance to make sure straps and nose clip are in the correct places, and make sure the respirator isn't too low on the face to provide a good fit).
4. The application scans the user's face a second time, looking for exactly where the respirator's metal nose clip is located. This measurement is compared to the original scan, to figure out where on the face the clip lies.
5. The application scans for the disposable respirator model (e.g. Aura 1873V+) or receives this as input from the user.
6. The application generates the complementary shape around the respirator on the outside of the nose plus disposable respirator, and the inside of the nose plus disposable respirator, adding a thin hinge between the two halves (or adding matching peg and holes on each side, to allow the user to reliably connect the two molds at the correct spot).
7. From the nose clip location the application recorded earlier, the application looks for the exact placement of the nose clip metal and adds raised or embedded arrows on either side of the nose clip, pointing to where the nose clip should be placed, on both sides of the nose mold.
8. The application adds 3M® logo, disposable respirator model number, and brief instructions to the outside of one half of the nose mold: optionally, it also prints the user's first name on the outside of the nose mold.

9. The application allows the user to download the resulting model file, so they can print the nose clip guide at their leisure. The user prints their nose mold and can use it until they can reliably form their own nose clip.

Example 3

1. A consumer/non-professional respirator user in a retail location (e.g. Home Depot® or other authorized distributor) uses a kiosk with the mobile application installed.
2. The kiosk application uses a camera or other optical sensor to scan the user's face to get the exact nose and face measurements.
3. The user puts a disposable respirator on their face without forming the respirator clip and adjusts it until they like where it sits on their face.
4. The application scans their face a second time, and measures exactly how far down the wearer's nose the disposable respirator sits.
5. The program then generates the complementary shape on the outside of and underneath the disposable respirator and generates a hinge-like attachment between the two shapes (alternatively, a fitted peg and hole on either side of the plastic nose mold, so the wearer can fit the pieces correctly). The mold includes two arrows or notches on either side of where the nose clip goes, pointing to exactly where the user should place the metal nose clip in the mold. The program also reads the disposable respirator model (using optical character recognition to read the disposable respirator itself, or takes the disposable respirator model input from the user).
6. The program sends this nose mold guide to a 3D printer. The printer prints the 3D nose clip mold guide in a few minutes, and the user can take the nose clip mold guide home with them.
7. The provided kit includes a nose clip mold guide with the 3M logo, the respirator model used, and brief instructions printed on it.
8. If the printer contains 2 colors (e.g. white and red), the arrows are printed in a different color to make it even more clear where the nose clip should be. This ensures that, regardless of where a particular disposable respirator wearer prefers to wear their respirator on their face, the user knows where exactly the respirator should sit on their nose, and that the respirator is fitted for that place the same way every time.

What is claimed is:

1. A method of custom fitting a respiratory protection device to a face of a user, the method comprising:

scanning the face of the user using an optical sensor;

mapping a skin surface topography of the user based on a scanning dataset;

forming a nose portion former, based on the mapped skin surface topography, wherein the nose portion former comprises an edge that has a matching contour to the mapped skin surface topography; and providing instructions to the user for forming a custom-fit nose portion of the respiratory protection device, wherein the instructions include the user aligning a deformable nose clip of the respiratory protection device with the nose portion former and pressing the matching contour into the nose clip.

2. The method of claim 1, wherein scanning the face of the user comprises:

scanning the bare face of the user; and scanning the face of the user while the user is wearing the respiratory protection device.

3. The method of claim 1, and further comprising:

receiving a respiratory protection device indication regarding the respiratory protection device.

4. The method of claim 1, wherein the nose portion former comprises a first portion and a second portion, wherein the first portion comprises the edge, and wherein pressing comprises pressing the first and second portions together around the respiratory protection device.

5. The method of claim 4, wherein aligning comprises the user placing the deformable nose clip of the respiratory protection device between the first and second portions, in an alignment position.

6. The method of claim 4, wherein the first portion is configured to contact an exterior of the respiratory protection device, and the second portion is configured to contact an interior of the respiratory protection device.

7. The method of claim 1, wherein forming the nose portion former comprises a rapid printing technique.

8. The method of claim 1, wherein the contour matches a bridge of a nose of the user, a shape of a nasal bone of the user, or a shape of a cartilage structure of a nose of the user.

9. A system for form-fitting a respiratory protection device to a wearer, the system comprising:

a scanning system comprising an optical scanner that scans a facial topography of a user of the respiratory protection device;

a nose portion crimper builder that receives a scan dataset of the facial topography and forms a nose portion crimper with a matching contour;

wherein, when the nose portion crimper is applied to a deformable nose clip of the respiratory protection device, it imparts the facial topography such that the respiratory protection device is custom fit to the user.

10. The system of claim 9, wherein the scanning system is configured to:

scan the bare face of the user to obtain a bare-face scan;

scan the face of the user while the user is wearing the respiratory protection device to obtain a covered-face scan; and wherein the scan dataset comprises the bare-face scan and the covered-face scan.

11. The system of claim 9, and further comprising:

a topography detector that, based on the scan dataset, detects the facial topography and generates the matching contour; and a facial mapper that maps a face of the user based on the detected facial topography.

* * * * *